US012171299B2

(12) United States Patent
Luna

(10) Patent No.: US 12,171,299 B2
(45) **Date of Patent: *Dec. 24, 2024**

(54) CONSTRUCTION UNIT AND SHOE INCORPORATING THE CONSTRUCTION UNIT

(71) Applicants: Smith Nevada Dynasty Trust, Las Vegas, NV (US); Sergio Luna, Las Vegas, NV (US)

(72) Inventor: Sergio Luna, Las Vegas, NV (US)

(73) Assignees: Smith Nevada Dynasty Trust, Las Vegas, NV (US); Sergio Luna, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/151,757

(22) Filed: Jan. 9, 2023

(65) Prior Publication Data

US 2023/0157406 A1 May 25, 2023

Related U.S. Application Data

(63) Continuation of application No. 17/391,016, filed on Aug. 1, 2021, now abandoned, which is a (Continued)

(51) Int. Cl.
*A43B 23/24* (2006.01)
*A43B 3/00* (2022.01)
(Continued)

(52) U.S. Cl.
CPC ..... *A43B 13/14* (2013.01); *A43B 3/0078* (2013.01); *A43B 3/24* (2013.01); *A43B 3/246* (2013.01); *A43B 23/24* (2013.01)

(58) Field of Classification Search
CPC ..... A43B 3/0078; A43B 3/24; A43B 3/246; A43B 23/24; A43B 13/14; A43B 13/00; A43B 13/223; A43C 19/00
(Continued)

(56) References Cited

U.S. PATENT DOCUMENTS 2,365,964 A 12/1944 Levine et al.
2,640,283 A * 6/1953 McCord ..... A43B 13/36 36/31
(Continued)

FOREIGN PATENT DOCUMENTS

DE 202011110219 U1 3/2013
WO 0112006 A1 2/2001
(Continued)

OTHER PUBLICATIONS

U.S. Appl. No. 29/774,407, filed Mar. 16, 2021, Sergio Luna.
(Continued)

*Primary Examiner* — Marie D Bays
(74) *Attorney, Agent, or Firm* — Connie R. Masters

(57) ABSTRACT

A footwear construction unit for receiving a decorative component is provided along with an embellished shoe that incorporates the construction unit. The construction unit comprises an upper unit body and a weight-bearing wall extending downwardly from the upper unit body, which together at least partially define an interior upraised area that, in some aspects of the invention, accommodates at least a portion of the decorative component to elevate the decorative component above the walking surface and to protect it from dirt and abrasion. In other aspects of the invention, the decorative component may extend across the arch, down the inner heel, through a décor-receiving channel inset in the weight-bearing wall, and/or onto other surfaces herein disclosed.

13 Claims, 35 Drawing Sheets

Related U.S. Application Data continuation-in-part of application No. 29/778,246, filed on Apr. 12, 2021, now Pat. No. Des. 984,115, and a continuation-in-part of application No. 16/983,773, filed on Aug. 3, 2020, now Pat. No. 11,304,474, which is a continuation-in-part of application No. PCT/US2020/028739, filed on Apr. 17, 2020, and a continuation-in-part of application No. 16/735,680, filed on Jan. 6, 2020, now Pat. No. 10,729,207.

(60) Provisional application No. 62/837,374, filed on Apr. 23, 2019.

(51) Int. Cl.
*A43B 3/24* (2006.01)
*A43B 13/14* (2006.01)

(58) Field of Classification Search
USPC ..... 36/25 R, 15, 136
See application file for complete search history.

(56) References Cited

U.S. PATENT DOCUMENTS 3,082,556 A * 3/1963 Luna ..... G09F 3/00 40/636
3,402,485 A * 9/1968 McMorrow ..... A43B 3/0078 101/368
3,538,628 A * 11/1970 Einstein, Jr. ..... A43B 3/0078 36/15
4,050,167 A * 9/1977 Senter ..... A43B 13/00 D2/952
4,712,314 A * 12/1987 Sigoloff ..... A43B 3/00 40/636
5,331,753 A * 7/1994 Rodibaugh ..... A43B 13/00 40/636
5,533,280 A * 7/1996 Halliday ..... A43B 3/24 36/15
5,586,354 A 12/1996 Chi
D384,794 S 10/1997 Merceron
D414,918 S 10/1999 McNaught
6,389,712 B1 * 5/2002 Schelling ..... A43B 13/122 36/31
6,442,869 B2 9/2002 Coomes
D468,079 S 1/2003 DeGrand et al.
6,813,847 B2 11/2004 Workman
7,246,453 B2 * 7/2007 Kim ..... A43C 11/16 36/15
D552,334 S 10/2007 Lee
D557,483 S 12/2007 Young et al.
D568,034 S 5/2008 Horton et al.
D586,091 S 2/2009 Koh
D588,790 S 3/2009 Issler
D593,734 S 6/2009 Issler
D594,190 S 6/2009 Andersen et al.
7,721,470 B2 * 5/2010 Long ..... A43B 23/24 36/136
D625,499 S 10/2010 Valle et al.
D627,547 S 11/2010 McClaskie
D657,944 S 4/2012 Casadei
D659,355 S 5/2012 Valle et al.
D669,668 S 10/2012 Paciotti
D669,669 S 10/2012 McClaskie
D670,484 S 11/2012 McClaskie
D670,485 S 11/2012 McClaskie
D670,897 S 11/2012 McClaskie
D698,135 S 1/2014 McClaskie
D699,025 S 2/2014 McClaskie
D699,422 S 2/2014 McClaskie
D702,029 S 4/2014 McClaskie
D715,521 S 10/2014 Silverman
D715,524 S 10/2014 Silverman
D715,525 S 10/2014 Silverman
D716,533 S 11/2014 Silverman
D716,534 S 11/2014 Silverman
D716,536 S 11/2014 Silverman
D716,537 S 11/2014 Silverman
D740,005 S 10/2015 Silverman
D740,006 S 10/2015 Silverman
D751,800 S 3/2016 Silverman
D753,378 S 4/2016 Silverman
D753,379 S 4/2016 Silverman
D753,380 S 4/2016 Silverman
D756,088 S 5/2016 Silverman
D756,089 S 5/2016 Silverman
D756,090 S 5/2016 Silverman
D756,091 S 5/2016 Silverman
D757,410 S 5/2016 Silverman
D757,411 S 5/2016 Silverman
D761,540 S 7/2016 Silverman
D765,367 S 9/2016 Silverman
D765,368 S 9/2016 Silverman
D765,369 S 9/2016 Silverman
D765,370 S 9/2016 Silverman
D765,958 S 9/2016 Silverman
D765,959 S 9/2016 Silverman
D798,035 S 9/2017 McDonald
D838,451 S 1/2019 Dolce et al.
D893,842 S 8/2020 Mokos et al.
D893,844 S 8/2020 Kroshinskaya et al.
10,729,207 B1 * 8/2020 Luna ..... A43B 23/24
11,304,474 B2 * 4/2022 Luna ..... A43B 23/24
2001/0042319 A1 * 11/2001 Coomes ..... A43B 13/36 36/15
2004/0088883 A1 * 5/2004 Workman ..... A43B 3/18 36/62
2005/0060917 A1 3/2005 Kenson
2005/0120589 A1 * 6/2005 Coomes ..... A43B 13/30 36/15
2005/0274043 A1 12/2005 DeSaix
2006/0042119 A1 * 3/2006 Workman ..... A43B 5/08 36/15
2007/0227039 A1 * 10/2007 Chaney ..... A43B 13/12 36/15
2013/0042422 A1 * 2/2013 Neal ..... A43B 13/32 83/14
2016/0007678 A1 * 1/2016 Silverman ..... A43B 1/0072 12/142 R
2016/0015130 A1 * 1/2016 Knox ..... A43B 21/52 36/136
2017/0119105 A1 * 5/2017 Perry ..... A43B 1/0072

FOREIGN PATENT DOCUMENTS

WO 0165960 9/2001
WO 2014115284 A1 7/2014
WO 2015033257 A1 3/2015
WO 2016164554 A1 10/2016

OTHER PUBLICATIONS

U.S. Appl. No. 29/776,291, filed Mar. 29, 2021, Sergio Luna.
U.S. Appl. No. 29/776,301, filed Mar. 29, 2021, Sergio Luna.
U.S. Appl. No. 29/776,342, filed Mar. 29, 2021, Sergio Luna.
U.S. Appl. No. 29/778,246, filed Apr. 12, 2021, Sergio Luna.
International Search Report and Written Opinion dated May 22, 2020 for Application No. PCT/US2020/028739.
Japan Patent Office, Office action dated Jun. 6, 2022, English translation.
Korean Patent Office, Notice of Submission of Opinions dated Jul. 14, 2022, English translation.
Supplementary European Search Report for application EP 21 18 9116. Date of completion: Dec. 3, 2021.
Supplementary European Search Report for application EP 20 79 3230. Date of completion: Nov. 15, 2021.
English Translation of DE202011110219U1.

* cited by examiner

CONSTRUCTION UNIT AND SHOE INCORPORATING THE CONSTRUCTION UNIT

CROSS-REFERENCE TO RELATED APPLICATIONS

This application is a continuation of U.S. patent application Ser. No. 17/391,016 filed on Aug. 1, 2021; said U.S. patent application Ser. No. 17/391,016 is continuation-in-part of US Design patent application Ser. No. 29/778,246 filed on Apr. 12, 2021, and is also a continuation-in-part application of U.S. patent application Ser. No. 16/983,773 filed on Aug. 3, 2020 that issued as U.S. Pat. No. 11,304,474 on Apr. 19, 2022; said U.S. patent application Ser. No. 16/983,773 is a continuation-in-part application of U.S. patent application Ser. No. 16/735,680 filed on Jan. 6, 2020 that issued Aug. 4, 2020 as U.S. Pat. No. 10,729,207; said U.S. patent application Ser. No. 16/735,680 claims priority to U.S. Provisional Patent Application No. 62/837,374 filed on Apr. 23, 2019, and is a bypass continuation-in-part of PCT/US20/28739 filed on Apr. 17, 2020, which also claims priority to said U.S. Provisional Patent Application No. 62/837,374 filed on Apr. 23, 2019; all of which are incorporated herein in their entirety.

FIELD OF INVENTION

This invention relates generally to footwear, and, more particularly, to a footwear construction unit with an upraised area in the underside for receiving a decorative component and to a shoe incorporating both the footwear construction unit and the decorative component installed in the upraised area.

BACKGROUND OF THE INVENTION

Shoes can not only protect the foot while walking but can also enhance a fashion ensemble or provide an avenue for personal expression. Shoes vary in style from sporty to casual to formal. Not only are the shoe uppers provided in a variety of styles and with a variety of embellishments, but it is also known in the prior art to incorporate interesting or enhancing designs in the shoe outsole. For example, an outsole may have treads that will print out an appealing design, a figure, a print, a symbol, or a message on a soft walking surface.

Yet outsoles are limited in their decorative aspects because the outsole provides a flat surface that touches the ground or floor and that bears the weight of the wearer. Any decoration on the bottom of the sole will become soiled. Boggs, et al. attempted to overcome this problem in PCT Application No. WO2009026373 that discloses an outsole having a clear outer layer through which an underlying decorative surface layer can be viewed. However, the clear outer layer will become dirty during the wearing of the shoes, which will obscure the decorative underlayer and make it unattractive for viewing.

Accordingly, there is a need for a footwear construction unit to create decorative footwear with an underside carrying a decorative element, which adds interest and appeal to the overall look of the shoe, but which is not soiled by touching the walking surface and which is not obscured by the soiling of a clear overlayer. Additionally, there is a need for shoe incorporating the inventive footwear construction unit.

BRIEF SUMMARY OF THE INVENTION

The present invention is directed to a footwear construction unit that accommodates a decorative component, is directed to a structural assembly that includes both the construction unit and decorative component and is also directed to an embellished shoe incorporating the structural assembly. The decorative component, when installed, is at least partially disposed within a raised lower portion of the construction unit, which supports the decorative component suspended or elevated above the ground. Due to the decorative component's placement in the upraised area, it does not touch the ground, thereby preventing damage or abrasion to the decorative component.

In some aspects of the invention, the decorative component extends beyond the upraised portion of the construction unit to cover all or part of the bottom surface of the arch and/or to cover all or part of the bottom surface of the remainder of the shoe, such as the inner, forward-facing surface of the heel (heel breast) or a portion of the heel seat surrounding the heel of the shoe.

The embellished shoe includes at least a heel section, a toe section, an arch section disposed between the heel and toe sections, a shoe upper, the decorative component, and at least one construction unit configured with an upraised area to receive at least a portion of the decorative component. In the first embodiment, the construction unit is a toe construction unit that, when integrated into the finished shoe, is positioned in the toe section of the shoe, and is sized, shaped, and configured to fit below the toe portion of a shoe. In a second embodiment of the invention, the construction unit may be a heel construction unit positioned in the heel section of the shoe. The heel construction unit is sized, shaped, and configured to fit below the heel portion of a shoe. In an aspect of the invention, one (toe or heel) construction unit may be used to form the embellished shoe. In another aspect of the invention, two (toe and heel) construction units may be used to form the embellished shoe. To prevent redundancy, the detailed description is provided herein in application to the toe construction unit without repeating the elements and details for the heel construction unit (spatially reversed compared to the toe construction unit). Though not repeated, one skilled in the art could apply the relevant elements and descriptions to the differing spatial arrangement of the heel construction unit. (To apply the description of the toe construction unit to the heel construction unit, the directions front or forward and back or rearward are reversed.)

The footwear construction unit includes an upper body and a vertically extending, weight-bearing wall extending downwardly below, and providing support and underpinning to, the upper body portion of the construction unit (and to the shoe itself). The weight-bearing wall extends vertically from the bottom of the upper body of the construction unit to the ground upon which the user walks.

The weight-bearing wall of the construction unit terminates rearwardly at a right back wall margin and a left back wall margin with a rearward gap defined between the right and left wall margins. The rearward gap allows viewing of the decorative component that is disposed within the interior upraised area. The left and right back wall margins may be of consistent width or may taper vertically.

The bottom of the upper body (forming the upper body roof) and the inner surface of the weight-bearing wall (forming the sides) together define the interior upraised area that accommodates the decorative component. The upraised area may be shallow or deep. Based on considerations such as artistic design, materials used, and structural stability, the weight-bearing wall may be thin or relatively thick, may be a single wall, may be a double wall, may be a segmented wall, may be a partial wall or full wall, or may be perforated with cavities or hollows. The weight-bearing wall may be solid or may have cutouts, slits, or other wall openings that enhance ornamentation but still provide support for the user to allow walking. A thicker weight-bearing wall provides a larger surface area to contact the walking surface for stability, but a thinner weight-bearing wall allows for a larger area available for application of, and viewing of, the decorative component.

The weight-bearing wall may have a height that is greater than, equal to, or less than the height of the upper body of the construction unit.

The disposition of a decorative element within the protected, upraised area near the bottom of the shoe allows viewing of the decorative element (for example, from behind, at a side angle, or when the wearer is seated) while protecting it from the dirt and grime of a walking surface. The decorative element may be flat or may have a three-dimensional appearance or characteristics. The decorative element is elevated so that it does not touch or encounter the ground.

In an aspect of the invention (when the construction unit is incorporated into a shoe), the top of the construction unit lies generally in a first, upper plane (near or adjacent to the bottom of the shoe upper). The bottom of the construction unit upper body and the top of the weight-bearing wall lie generally in a second (middle) plane. And the weight-bearing wall comprises a framework that runs along at least a portion of the sides and front of the upper body and extends downwardly to terminate in a bottom boundary lying in a third (lower) plane. The weight-bearing wall may be a peripheral wall or may be inset from the periphery of the shoe.

In another aspect of the invention, the weight-bearing wall comprises multiple wall sections that extend downwardly from at least one of the sides and/or the front of the upper body of the construction unit and that extend downwardly to terminate in a multi-segment bottom boundary lying in the third, lower plane, as seen in FIG. 12-14, 31.

In an additional aspect of the invention, the weight-bearing wall flares at or near the bottom boundary, which increases the surface area for engagement with the walking surface, as compared to a weight-bearing wall that does not have the flared portion and does not become thicker at the bottom.

In a further aspect of the invention, the decorative component is disposed only in the upraised area of the construction unit.

In another aspect of the invention, the decorative component is disposed in the upraised area of the construction unit and extends across the sole of the arch of the shoe.

In an additional aspect of the invention, the decorative component is disposed in the upraised area of the construction unit, extends across the arch of the shoe, and extends down the inner surface of the heel of the shoe.

In a further aspect of the invention, the decorative component is disposed on a portion of a heel seat surrounding the heel of the shoe.

In a further aspect of the invention, a single construction unit is incorporated into the toe of an embellished shoe of the present invention.

In another aspect of the invention, both a toe construction unit and a heel construction unit are incorporated into the embellished shoe of the present invention.

In another aspect of the invention, the construction unit includes a tread portion disposed at the bottom boundary of the weight-bearing wall.

In an additional aspect of the invention, the construction unit comprises an upper shoe-unit interface, a mid-base, and a foundational base.

In an additional aspect of the invention, an encasement is provided for attachment over at least the body inner roof surface.

In a further aspect of the invention an inlay is fixedly attached to at least a portion of the outside surface of the encasement.

In an additional aspect of the invention, the construction unit is formed unitarily as a single piece.

In another aspect of the invention, the construction unit is formed of multiple, fixedly connected pieces.

The object of the invention is to provide a construction unit and a shoe incorporating the construction unit along with a decorative component which gives an improved performance over the above-described prior art.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Shown throughout the figures, the present invention is directed toward a footwear construction unit for receiving a decorative component and toward an embellished shoe utilizing the footwear construction unit and the decorative component. The decorative component is disposed in at least an upraised portion of the construction unit, which protects the decorative component from dirt and abrasion because it is elevated above the walking surface. In one aspect of the invention, the decorative component extends from the roof of the upraised portion of the construction unit across the arch portion of the shoe sole and further to the breast portion of the shoe heel. In another aspect, the decorative component also extends vertically down the inner surface of the weight-bearing wall of the construction unit. In a further aspect, the decorative component may be additionally disposed on a portion of a heel seat exterior of an attached heel.

Figure 1:
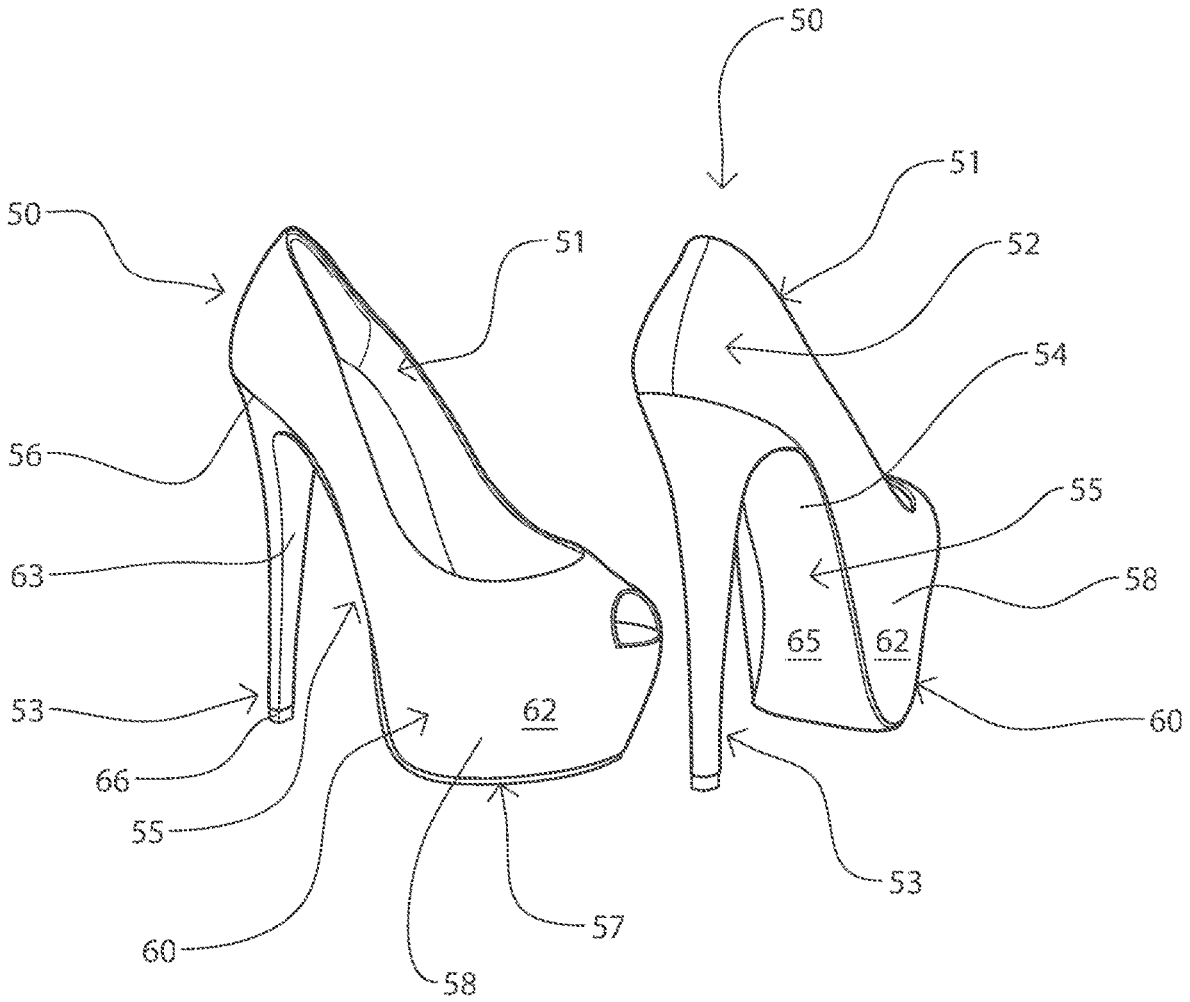
FIG. 1 Prior Art
FIG. 1 is a perspective view of a pair of high-heeled shoes of the prior art.

Referring now to the drawings, a conventional shoe 50 of the prior art is shown in FIG. 1. The prior art shoe 50 includes a heel 53, a toe 60, an arch 55, an outsole 65, and an upper 51.

The upper 51 defines a volume for partially enclosing a wearer's foot and typically includes an upper outer covering 52 (such as leather, imitation leather, fabric, or the like) and may optionally include an insole disposed to cover the footbed of the upper 51 for comfort of the wearer. The upper 51 may be a portion of a shoe of any type, such as a dress shoe, loafer, mule, boot, bootie, sandal, thong, or the like. The upper 51 may be joined to the heel 53 at heel-upper joint 56. The heel 53 provides support for the heel portion of the upper, and in most aspects of the invention it also elevates it.

The heel 53 may be a high heel, as illustrated in FIG. 1, or a medium, low, or flat heel. The outsole 65 forms the finished bottom of the shoe 50 including the walking surface and may also comprise one or more midsole layers (not shown). The outsole 65 may include any, or all, of a toe outsole 57 below the toe section 60, an arch outsole 54 below the arch section 55, a heel breast 63 covering, and a heel cap 66 disposed at the bottom surface of the heel 53. In some aspects of the invention, a platform 58 may be disposed at the lower part of the toe section 60, as in the exemplary high-heeled shoe illustrated, and may serve to elevate the toe portion of the upper for aesthetic reasons. In this case, toe platform covering material 62 may be disposed on the outer surface of the platform 58 to coordinate with or contrast with the rest of the shoe 50 or to otherwise enhance the look of the shoe 50.

Figure 2:
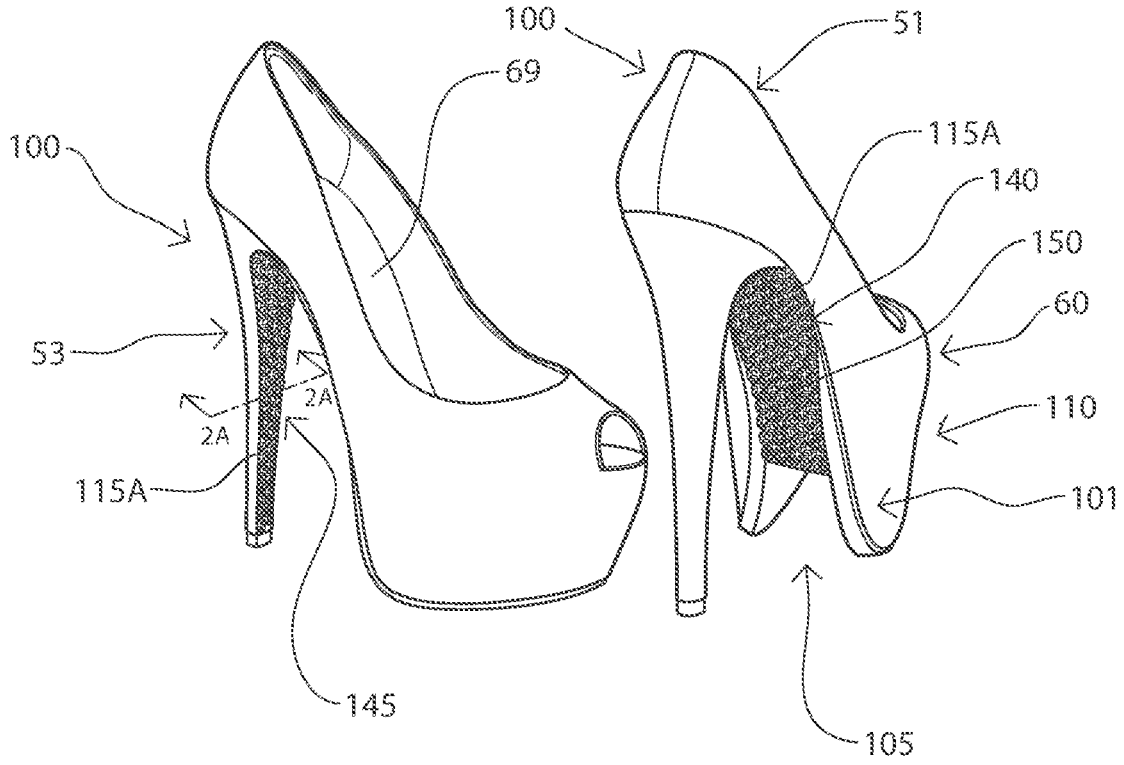
FIG. 2 is a perspective view of a first embodiment of the embellished high-heeled shoe of the present invention constructed with a toe construction unit having a tall weight-bearing wall and an upraised portion accommodating a decorative component, where the decorative component covers the floor of the upraised portion, the arch, and the inner forward-facing, breast portion of the heel.
Figure 9:
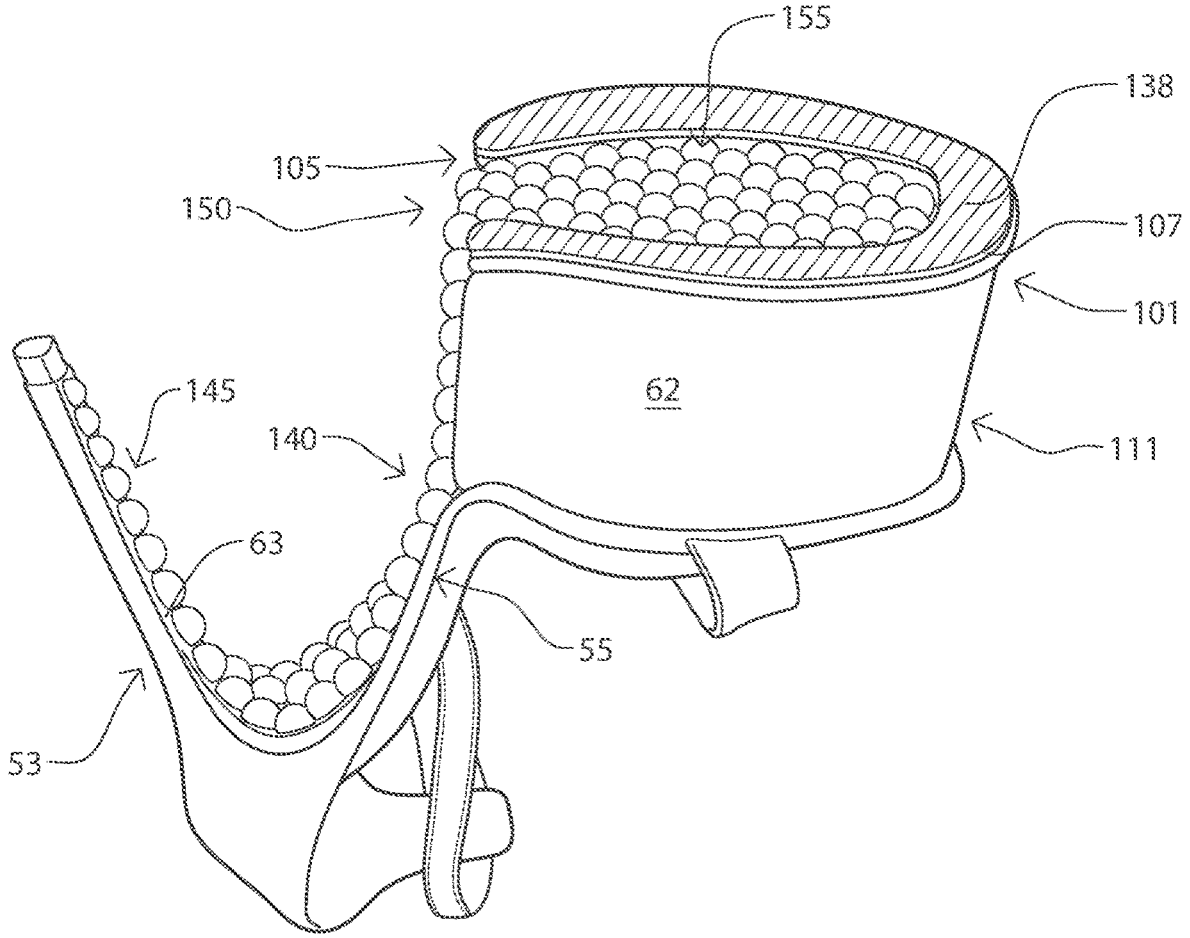
FIG. 9 is a bottom perspective view of the embellished shoe of the present invention that includes a toe construction unit with a short weight-bearing wall and includes a decorative element disposed within the upraised area and extending across the arch and down the heel breast.

In FIG. 2, an embellished shoe, shown generally as reference number 100, is illustrated in accordance with a first embodiment of the present invention. As shown, the embellished shoe 100 comprises the heel 53, toe 60, arch 55, and an upper 51 of the prior art shoe 50, and it also comprises a shoe structural assembly that includes both a decorative component 150 and a construction unit 110. The construction unit 110 is configured with an upraised area 105 (FIGS. 2, 4-5) for receiving at least a portion of the decorative component 150. The decorative component 150 may be disposed directly or indirectly on part or all of the undersurfaces of the shoe toe 60, arch 55, and/or heel breast 63 and may comprise a toe decorative element 155 (FIG. 9), arch decorative element 140, and/or heel decorative element 145.

In some embodiments of the invention, a single construction unit 110 (a toe construction unit) is utilized to form the embellished shoe 100, as seen in FIGS. 2, 6, 9, 17-21, 24, 29-31, 33, 35-40. In other embodiments of the invention (FIGS. 12-13), both a toe construction unit 110 and a heel construction unit 160 are utilized to form the embellished shoe 100.

Figure 3:
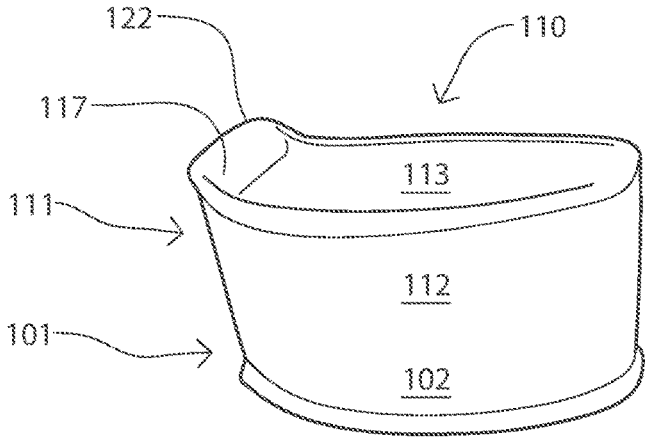
FIG. 3 is a top perspective view of a right side of the construction unit with a tall weight-bearing wall of the present invention.
Figure 4:
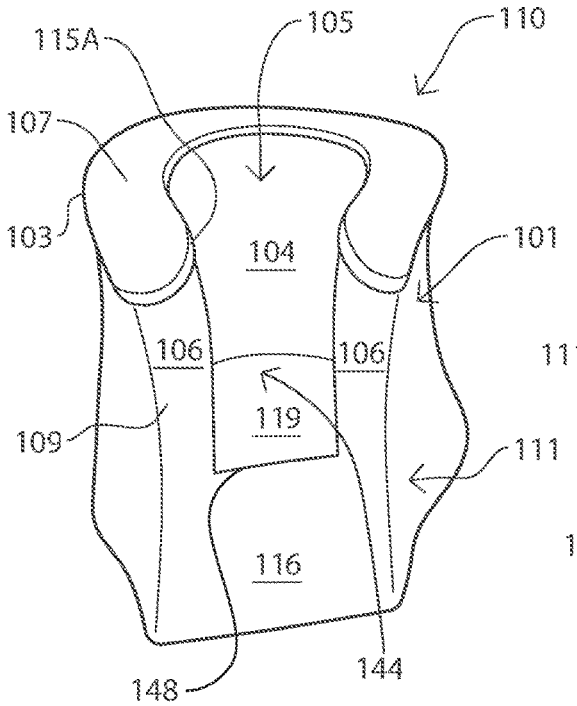
FIG. 4 is a perspective bottom rear view of a construction unit with a tall weight-bearing wall of the present invention.
Figure 5:
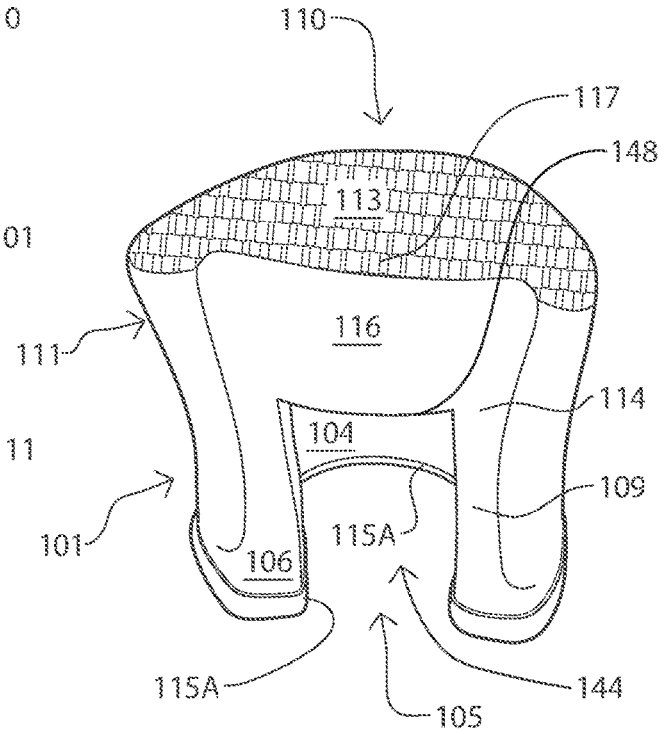
FIG. 5 is a perspective top rear view of a construction unit with a tall weight-bearing wall of the present invention.
Figure 7:
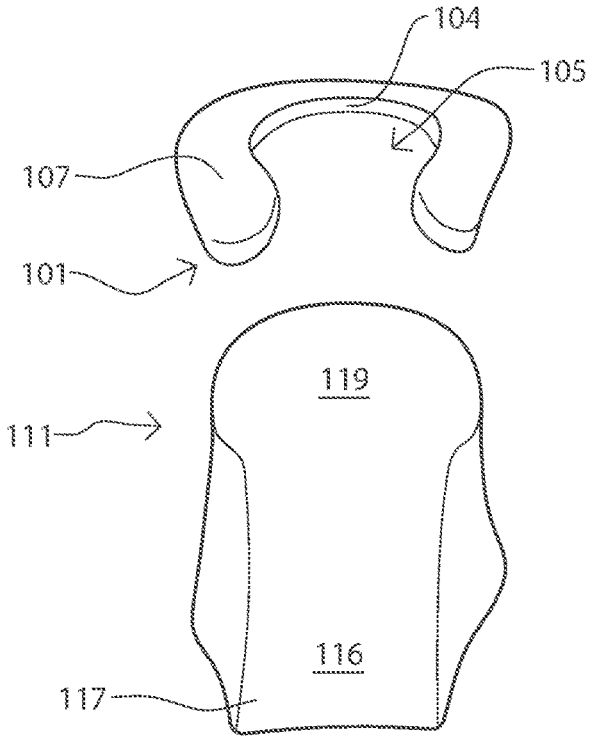
FIG. 7 is an expanded bottom rear perspective view of a two-piece construction unit of the present invention with a short weight-bearing wall.
Figure 8:
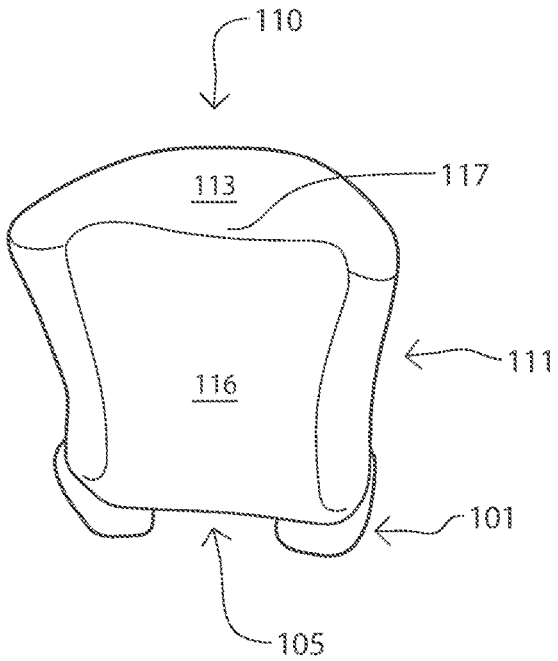
FIG. 8 is a perspective top rear view of the two-piece construction unit of FIG. 7.

The construction unit no comprises an upper unit body 111 and a lower weight-bearing wall 101, which, in a preferred aspect, are formed unitarily, as in FIGS. 3-5. In another aspect, they may be formed separately and fixedly attached, as in FIGS. 7-8.

In the finished shoe, the construction unit 110 is fixedly joined to the shoe. Specifically, a construction body top surface 113 (FIGS. 3, 5, 8), which is the top surface of the upper body in portion of the construction unit, is fixedly attached, directly or indirectly, to the bottom of the shoe upper portion at an upper first level. Various standard shoe elements may be incorporated into the upper 51 or disposed between the upper 51 and the body top surface 113, such as midsoles, outsoles, portions of the upper, and other elements as known in the art. The body top surface 113 may be configured to enhance the adherence of the top body surface 113 to the toe upper portion. A bonding agent may be used with or without additional mechanical devices. For example, the body top surface 113 may be irregular. The top body surface 113 may be textured or scored or otherwise treated to increase the surface area to enhance bonding, as shown in FIG. 5. The body top surface 113 may be configured with concave dimples to be received by corresponding convex hollows within the toe upper portion. Or the body top surface 113 and the toe upper portion may be configured with channels 157, 158 (FIG. 17) for receiving monofilament 159 (which may be concealed by a covering) to mechanically tie the parts together.

The upper unit body 111 of the construction unit extends vertically downward from the body top surface 113 to an intersectional area 114 (FIG. 5) that is generally at the level of the body inner roof surface 119. The weight-bearing wall 101 extends downwardly from the intersectional area 114 to the ground.

Figure 40:
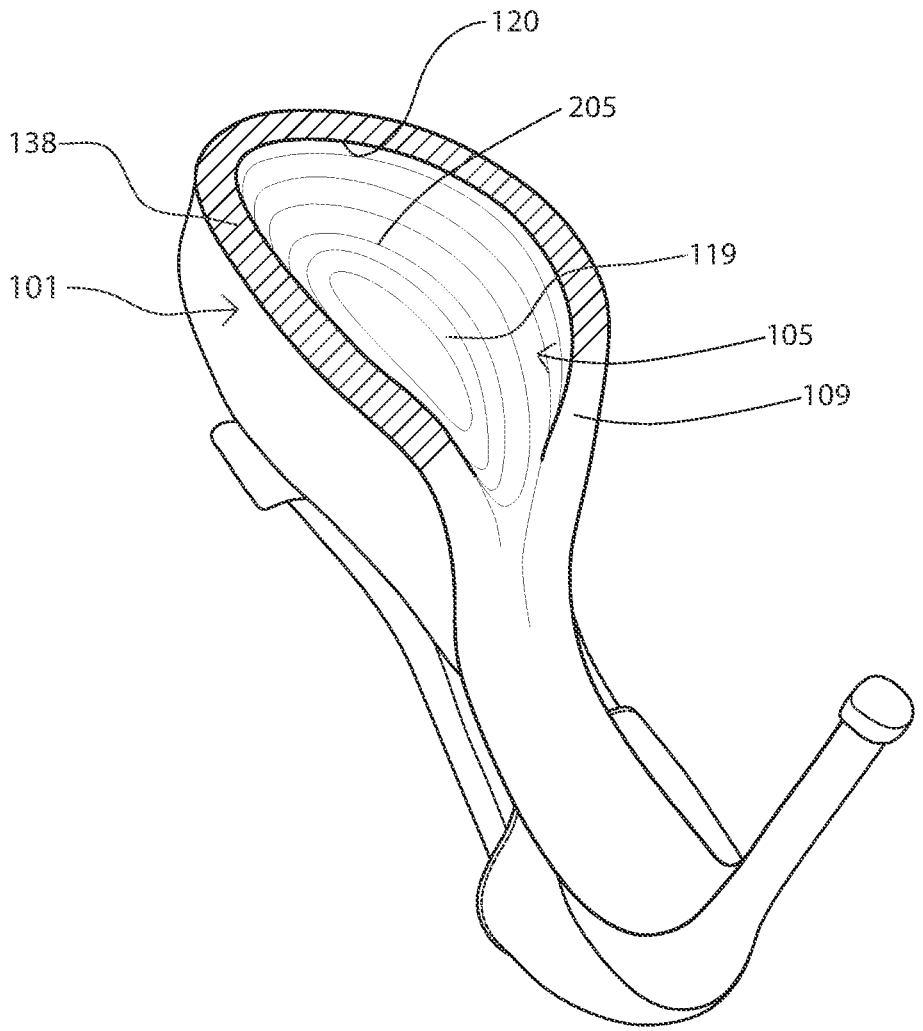
FIG. 40 is a perspective bottom view of a shoe of the present invention incorporating a construction unit with an inwardly curved weight-bearing wall.

The upper unit body 111 of the construction unit extends horizontally from front to back from a body front surface 118 (FIG. 14) to a body back surface 116 (FIG. 5) and extends horizontally from side to side between right and left lateral body lateral outer surfaces 112 (FIG. 3). The weight-bearing wall 101 extends downwardly from at least a portion of the periphery of the sides and front of the upper body 111 to the ground in the first embodiment but extends downwardly from an area inset from the periphery in FIGS. 34-39. The thickness of the weight-bearing wall 101 is the distance between the weight-bearing wall exterior surface 102 (FIG. 3) and the weight-bearing wall interior surface 104 (FIGS. 4-5). This thickness may vary in portions of the weight-bearing wall 101 (as seen in FIG. 40) or remain constant throughout the entirety of the weight-bearing wall 101. In one aspect, the weight-bearing wall 101 is thin but expands outwardly slightly at the out the bottom to form a flare 103 (FIGS. 4-5). If the thickness of the wall 101 is thin, more space is allowed in the interior upraised area 105, which can accommodate the decorative component 150, while maintaining the functionality of bearing the weight of the wearer. In another aspect of the invention shown in FIG. 25, the wall 101 is thick, which reduces the space for the decorative component 150 but increases the area of the bottom boundary 107. The wall 101 surrounds the body inner roof surface 119 that is at the second (middle) level, which is lower than the upper first level at the body top surface 113.

The weight-bearing wall 101 ends at the back on the right and on the left at the right and left peripheral back margins 109 (FIGS. 4-5). An open space 144 is defined between the right and left peripheral back margins 109, and there is no weight-bearing wall 101 extending downwardly from the center 148 of the back of the upper body 111. This creates the open space 144 between the right and left peripheral back margins 109 (FIGS. 4-5), which allows viewing of the decorative component 150 (which will be disposed within the interior upraised area 105. In the first embodiment, the right, front, and left exterior surface 102 of the weight-bearing wall 101 substantially aligns with the body right outer surface 112, the body front surface 118, and the body left outer surface 112, thereby giving a smooth, finished look.

Figure 15:
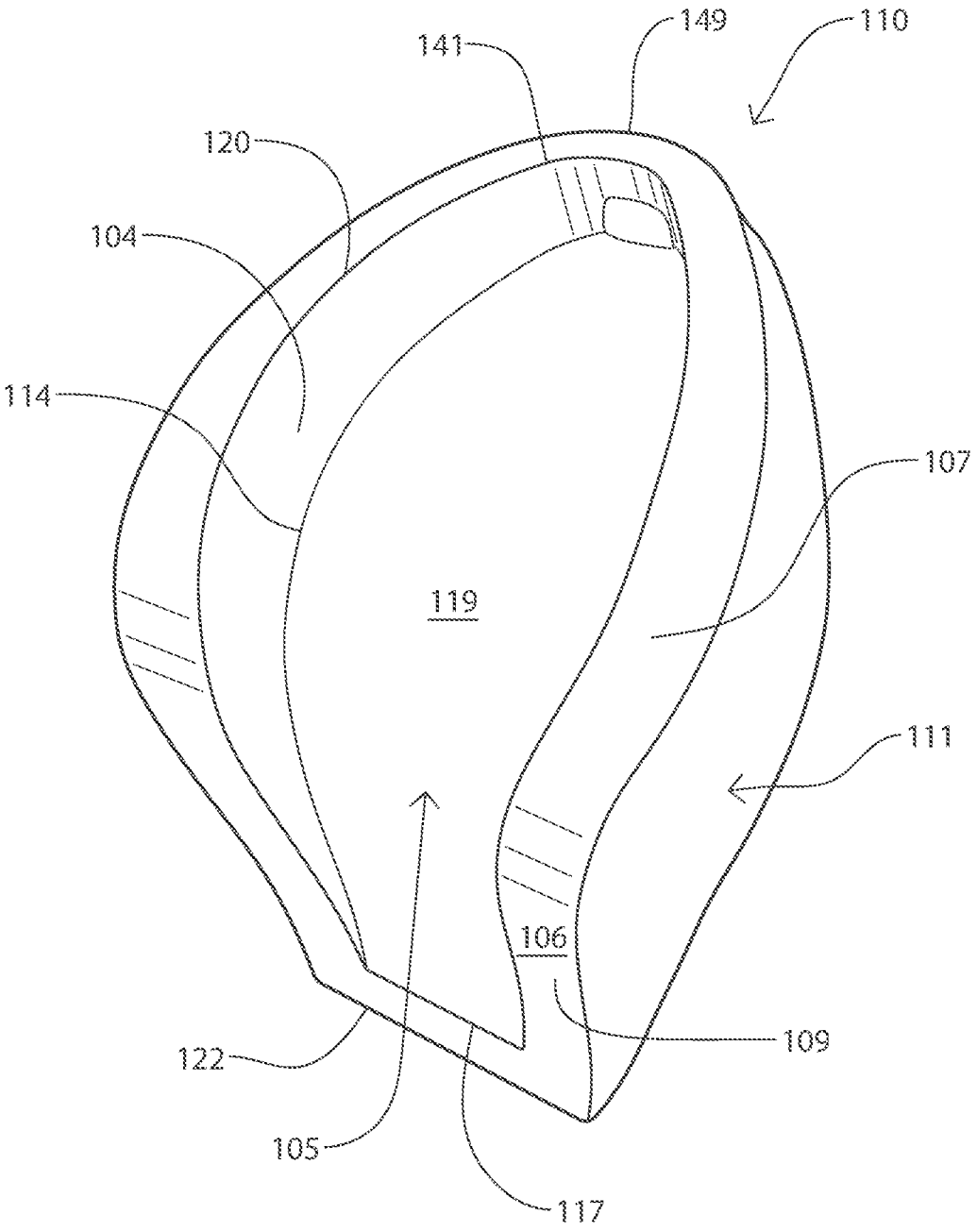
FIG. 15 is a perspective back rear view of the construction unit of the present invention with a weight-bearing wall terminating in a right and left back wall margin of consistent width.
Figure 25:
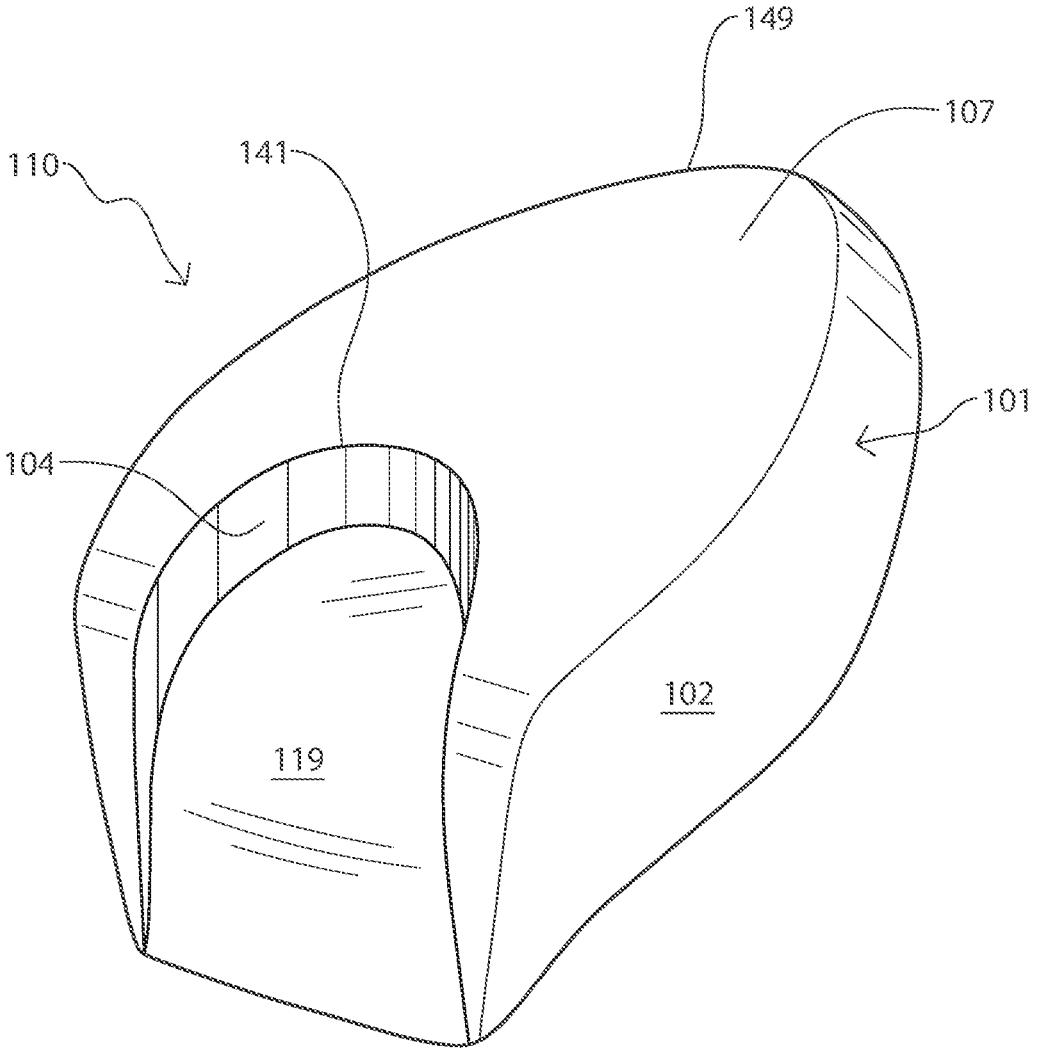
FIG. 25 is a perspective back view of the bottom of the construction unit of the present invention with a thick weight-bearing wall, which causes the roof of the unit body of the construction unit to be reduced in area and causes the bottom boundary to be increased in area.
Figure 26:
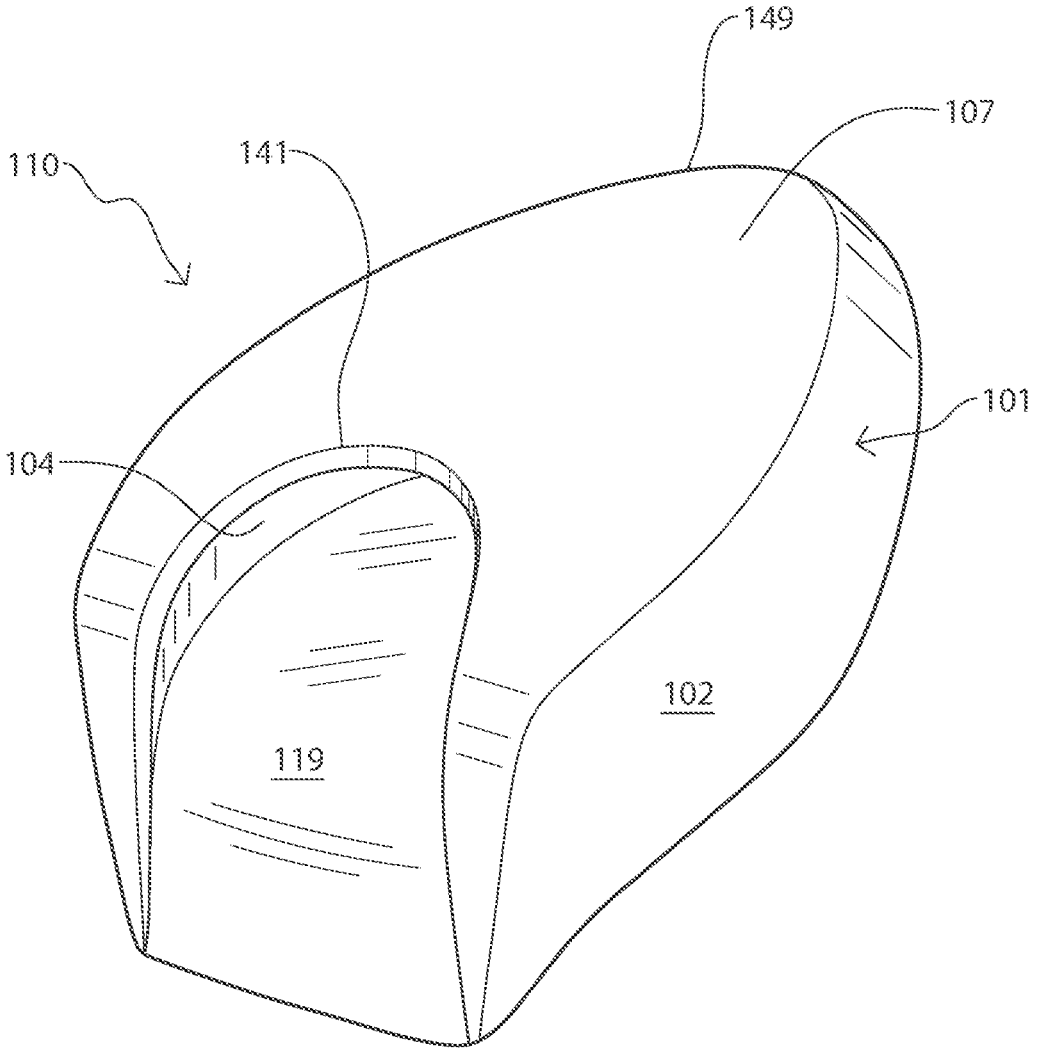
FIG. 26 is a perspective back view of the bottom of the construction unit of the present invention with a thick weight-bearing wall with a concave inner wall having a bottom boundary spanning a portion of the area between the opposing unit sides to form a grotto within the construction unit.

The weight-bearing wall 101 extends downwardly from the intersectional area 114 (FIG. 5) to terminate in a bottom boundary 107. The bottom boundary 107 extends from a bottom boundary outer edge 149 (FIGS. 15, 25, 26) to a bottom boundary inner edge 141 (FIGS. 15, 25, 26). The bottom boundary 107 meets the inner wall 104 at inner junction 120 (FIG. 15, 40), which in some aspects of the invention, such as in FIG. 15, corresponds to the bottom boundary inner edge 141. In FIG. 15, wall-boundary inner junction 120 is a substantially right-angle corner. In other aspects of the invention, the wall-boundary inner junction 120 may not form a right angle but may be curved, less than ninety-degrees, more than ninety-degrees, or curved less than ninety-degrees, more than ninety-degrees, or curved, as seen in FIG. 40. The bottom boundary 107 is disposed at a third level that is lower than a second level, and which is generally at least partially planar. Bottom boundary 107 may be the walking surface or may be covered entirely or partially with a tread, outsole, protective sole cover 173, or encasement 180 (FIGS. 20-21) based on considerations of style and functionality. Bottom boundary 107 may optionally be configured with texturing or grooves 138 (FIGS. 9, 40) to increase traction.

The upraised area 105 is an open space that serves as a decoration-receiving recess. The upraised area 105 has a top (as oriented as in FIG. 5 and as oriented when incorporated into a shoe) defined by the body inner roof surface 119 (FIG. 4) of the upper body 111 and has sides defined by the inner wall surface 104 of the weight-bearing wall 101. There is a gap between the right and left peripheral back margins 109 of the weight-bearing wall 101 with nothing bridging the gap, so that the back portion of the weight-bearing wall 101 is open.

The body inner roof surface 119 is disposed at the second level. The second level is above the third level, which thus elevates the top of the upraised area 105 above the walking surface and thus minimizes or eliminates damage to and sullying of the decorative component 150 carried within the upraised area 105. The height of the weight-bearing wall 101 is generally the distance between the second and third levels, while the height of the upper body 111 is generally the distance between the first and second levels. The height of the weight-bearing wall 101 may vary based on the height of the decorative component 150 and on stylistic and functional requirements. For example, the height of the wall 101 is significantly less in the man's shoe of FIG. 33 than the woman's platform shoe of FIG. 2. The height of the weight-bearing wall 101 is greater than the height of the decorative component 150, so that the decorative component 150 is elevated above the ground.

Figure 28:
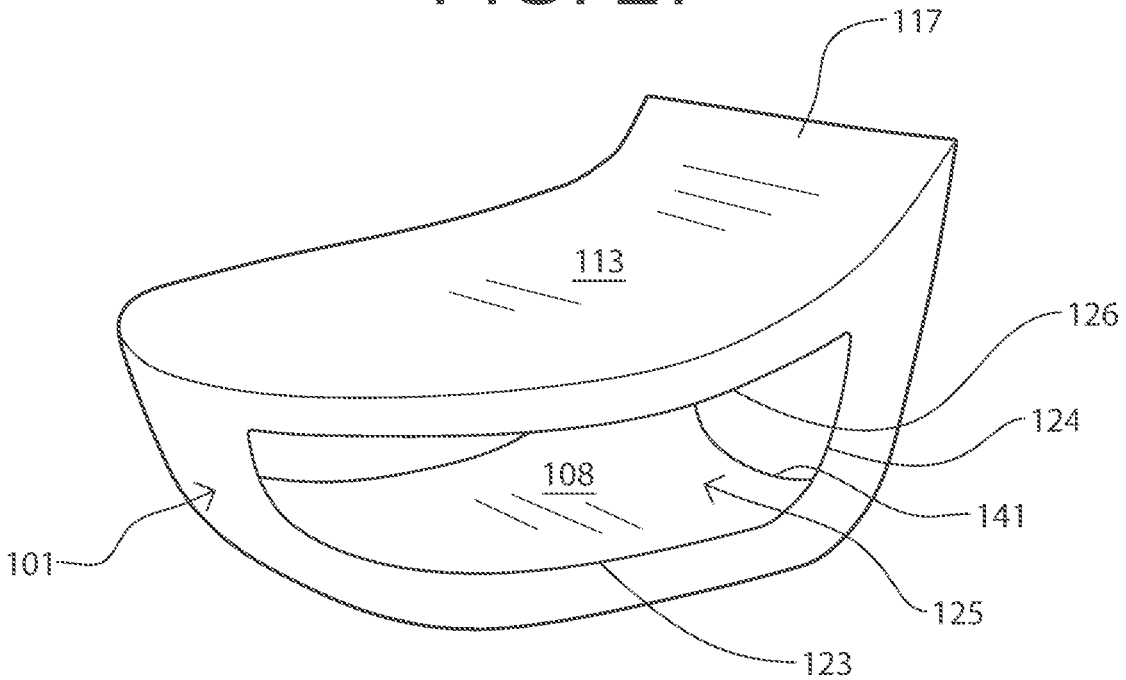
FIG. 28 is a perspective top side view of the construction unit of FIG. 27.

Because the back (between the peripheral back margins 109) of the weight-bearing wall 101 is open, the decorative component 150 can be directly or indirectly fixedly attached to the body inner roof surface 119 and can run continuously out the back of the upraised area 105 between the right and left peripheral back margins 109 (FIGS. 4-5). In one aspect, the decorative component 150 is further disposed on, and directly or indirectly fixedly attached to, the inner surface of the weight-bearing wall 101. In another aspect, the decorative component is also disposed on, and directly or indirectly fixedly attached to, the bottom surface of the arch section 55 of the shoe and/or the heel breast 63. The decorative component 150 comprises one or more of a toe decorative element 155 (FIG. 9) attached to a toe decoration-receiving surface (body inner roof surface 119), an arch decorative element 140 (FIG. 9) attached to an arch decoration-receiving surface (arch surface 54, FIG. 1), a heel decorative element 145 (FIG. 9) attached to a heel decoration-receiving surface, and a body inner floor (grotto) decorative element attached to a body inner floor surface (grotto floor) 108 (FIG. 28). In some aspects of the invention, the decorative component 150 also is disposed on, and directly or indirectly fixedly attached to, all or at least a portion of the inner wall surface 104 of the weight-bearing wall 101 that partially defines the upraised area 105.

The decorative component 150 has a height less than the height that the inner wall surface 104 extends below the body inner roof surface 119, which prevents scratching or soiling of the decorative component 150. The decorative component 150 may be substantially flat (such as a brightly colored sheet, dye, or film of iridescent material), may be thin (such as ostrich skin or alligator skin), may have a medium thickness (such as the half pearls of FIG. 9), or may have a taller height up to a height just less than the height of the recess (such as multi-jeweled chains extending from the body inner roof surface 119 and having a height just less than the height of the inner wall surface 104). For example, the decorative components may comprise crystals, rhinestones, ceramic beads or particles, glass beads or particles, porcelain, textiles, sequins, mirrors or pliable mirror foiling or plastic mirror film, links of chains, metal electroplating (gold, silver, copper, and the like), fur, dye, precious stones (diamonds, emeralds, rubies, and the like, semiprecious stones, exotic skins, leathers including quilted or printed leathers, and other two-dimensional and three-dimensional synthetic or natural materials. The decorative component 150 may be individual, linked, or composite elements fixedly attached to the decoration-receiving surface, may be a sheet of material (substrate 177 of FIG. 2A) with individual, linked, or composite elements fixedly attached to the substrate 177 that is then fixedly attached to the decoration-receiving surface, may be a sheet of material with an attractive pattern, color, or texture, or may be a combination of individual, linked, or composite elements and a sheet of material with an attractive pattern, color, or texture. Individual elements of the decorative component 150 may be set in individual settings or may be set in channels. The elements of the decorative component 150 may be of a consistent size or may vary in size. In an exemplary aspect, shown in FIG. 2, the decorative component 150 comprises a substrate 177 embedded with or otherwise carrying rhinestones. In an exemplary aspect shown in FIG. 9, the decorative component 150 comprises multiple half spheres, such as half pearls. In the exemplary aspect of FIGS. 12-13, the decorative component 150 comprises individual medallions, nail heads, or studs fixedly adhered to the decoration-receiving surface.

In one aspect of the invention, the height of the weight-bearing wall 101 (around upraised area 105) of the construction unit 110 has a height that is greater than the height of the upper unit body 111. This aspect can be seen in FIGS. 3-5 in which the inner wall surface 104 of wall 109 has a height that is greater than the height of the back surface 116 of the body 111. In this aspect, the distance between the first plane and second plane is smaller than the distance between the second and third planes.

In another aspect of the invention, the height of the weight-bearing wall 101 has a height that is less than the height of the unit body 111. This aspect can be seen in FIGS. 7-8 in which the inner wall surface 104 has a height that is much less than the height of the body back surface 116. In this aspect, the distance between the first plane and second plane is larger than the distance between the second and third planes.

Figure 10:
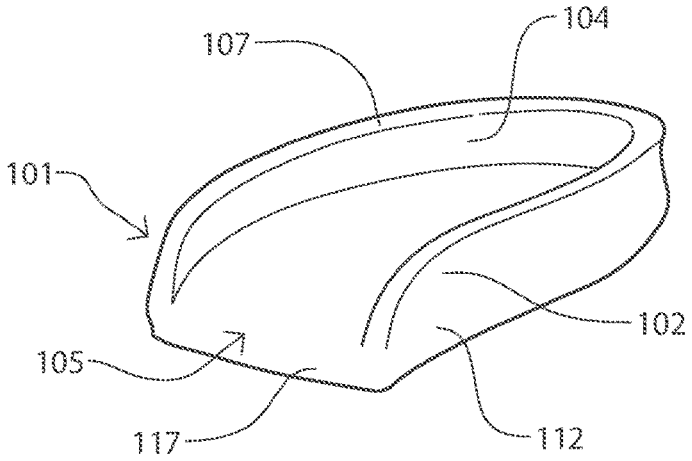
FIG. 10 is a perspective back view of the bottom of a unitarily formed, one-piece construction unit of the present invention with a short, thin weight-bearing wall.

In an additional aspect of the invention, the height of the weight-bearing wall 101 has a height that is approximately equal to the height of the body 111, as seen in FIG. 10.

The body top surface 113 is shaped, sized, and configured to be fixedly attached to the bottom surface of the toe section 60 of the upper 51. Thus, the body top surface 113 of the upper body 111 will, in general, correspond to the general shape of the toe section 60 (such as generally V-shaped for pointed-toed shoes or generally U-shaped for rounded-toed shoes). And in some aspects of the invention, the outer body surface and weight-bearing wall 101 will follow the V- or U-shape of the toe, but in other aspects, such as in FIG. 31, may be varied based on design and functional considerations.

The direct or indirect (such as with intermediary layers) attachment of the construction unit 110 to the bottom of the toe section may be by means of a glue, adhesive, or other bonding agent; may be by mechanical means such as screws, monofilament 159 (FIG. 17) tying the two together, or other mechanical devices; or may be by a combination, such as the use of both a bonding agent and one or more mechanical devices. The monofilament 159 may be disposed within a channel 157, 158 in either, or both of, the construction unit 110 and the shoe upper portion and may be used to sew or bind them together.

In one aspect, as seen in FIG. 3, the rear portion 148 of the upper body m is configured with a wedge 117. The wedge 117 extends upwardly at the back of the body top surface 113, which follows the line of the shoe upper between the toe section and the arch section to form an incline or ramp. The wedge 117 tapers rearwardly to an edge 122. For some styles of shoes, the inclusion of the wedge 117 enhances the attachment of the body 111 to the upper 51 (or to a midsole disposed between the upper 51 and the wedge 117) and increases the robustness of the upper body 111.

Also seen in FIG. 3, the body outer surface 112 extends vertically downwardly from the periphery of the body top surface 113. The weight-bearing wall outer surface 102 also extends vertically downwardly and is generally aligned with the body outer surface 112. This alignment creates a smooth façade, which may be covered with a covering 62 (FIG. 6) or may be left exposed based substantially on aesthetic considerations. Similarly, as seen in FIG. 5, the body back surface 116 extends downwardly from the back edge 122 (FIG. 3) of the body top surface 113 and/or the back wedge 117. And the weight-bearing wall back surface 106 extends downwardly in general alignment with the body back surface 116 to create a smooth façade, which may be covered by a footwear material or may remain uncovered.

Figure 6:
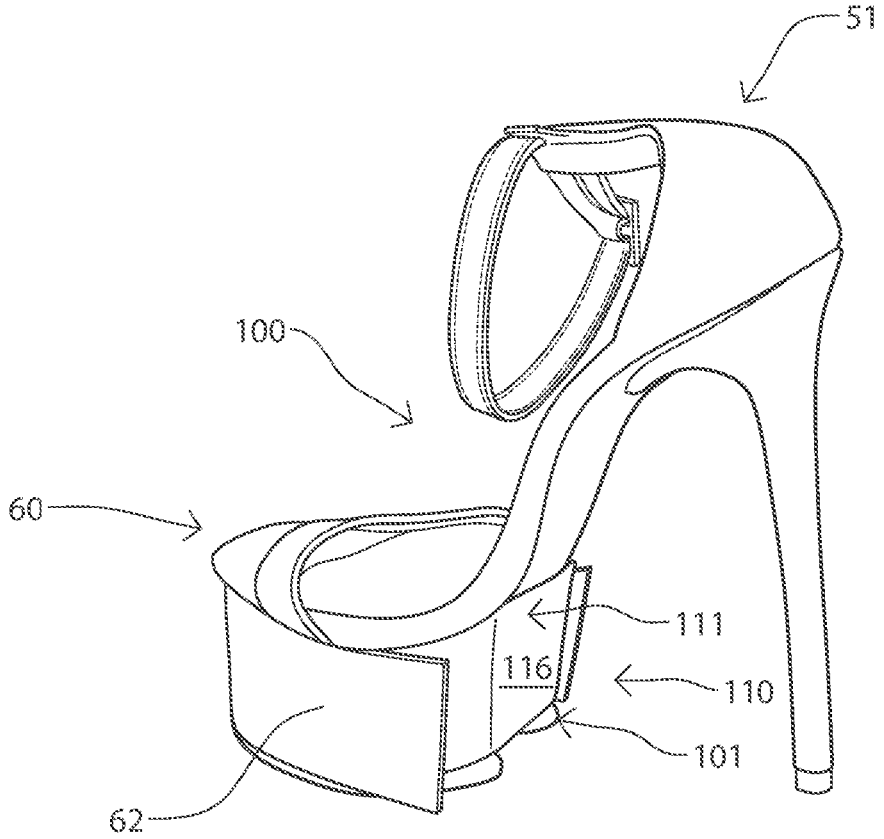
FIG. 6 is a side perspective view of a partially assembled embellished shoe of the present invention that incorporates a toe construction unit having a short weight-bearing wall.

FIG. 6 illustrates a partially assembled embellished shoe 100, which shows a step in an exemplary assembly. In manufacturing the embellished shoe 100, the body top surface 113 is fixedly attached to the bottom surface of the toe section 60 of the shoe upper. Therefore, preferably, the outer perimeter of the upper body 111 and the outer perimeter of the weight-bearing wall 101 conform to the shape of the outer perimeter of the upper toe section 60 to produce a smooth façade. However, based on design decisions or aesthetic considerations, the creation of a smooth façade is not necessary to the invention.

In an aspect of the invention, as seen in FIG. 6, the perimeter of the body 111 and of the weight-bearing wall 101 are covered with a covering 62, which may match, coordinate with, or contrast with the material forming the shoe upper 51 based on aesthetic considerations. The covering 62 may be selected by the manufacturer to veneer the body outer surface 112 and wall outer surface 102 with ornamental material that may match with, coordinate with, or contrast with the decorative component 150 and/or the material forming the shoe upper 51.

In another aspect of the invention, the perimeter of the body 111 and of the weight-bearing wall 101 remain uncovered with the material forming the construction unit exposed.

In a further aspect of the invention, the bottom boundary 107 may be textured, smooth, or grooved 138 to provide additional traction.

Figure 18:
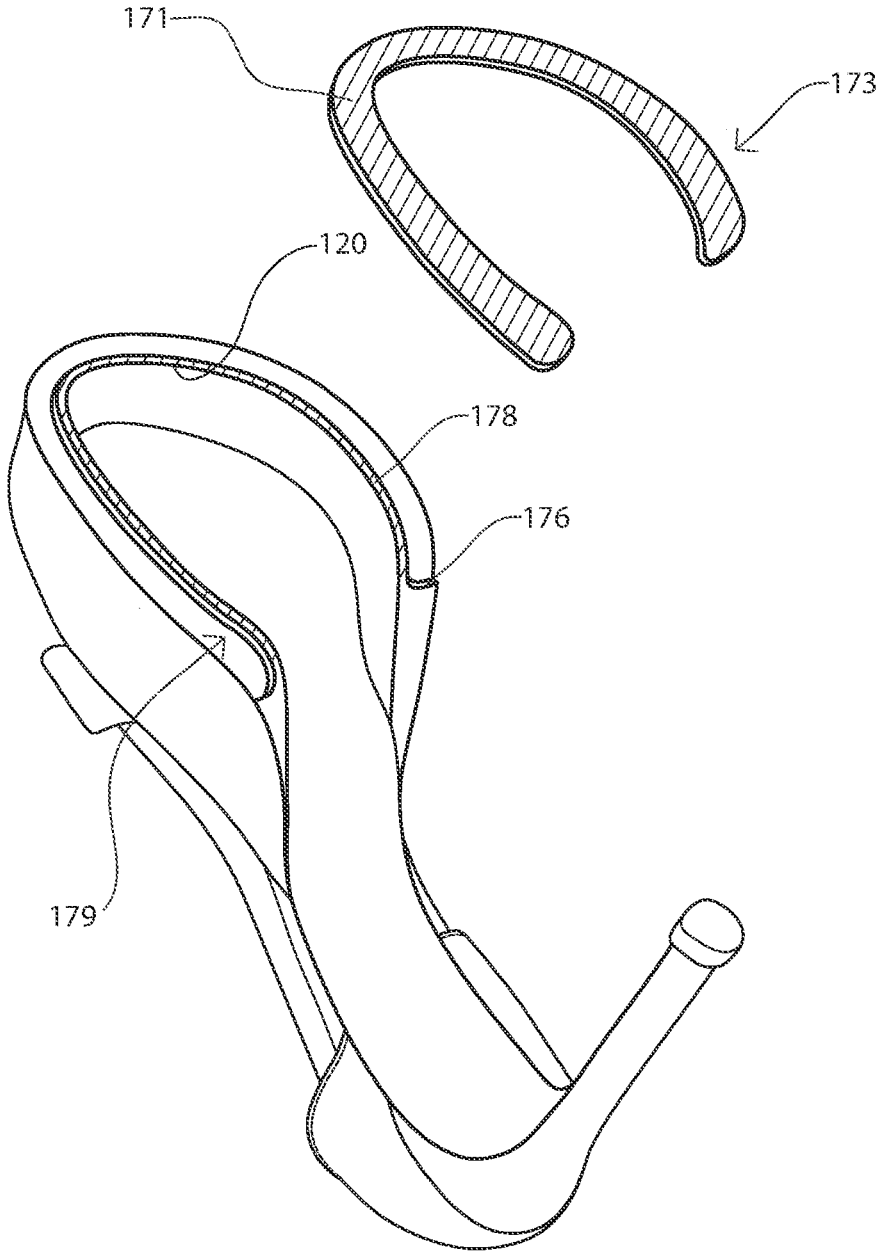
FIG. 18 is a perspective bottom view of a shoe of the present invention incorporating the construction unit having a weight-bearing wall terminating in tapering right and left back wall margins and having an inset channel in the bottom boundary of the construction unit or an encasement for receiving a protective sole cover.
Figure 19:
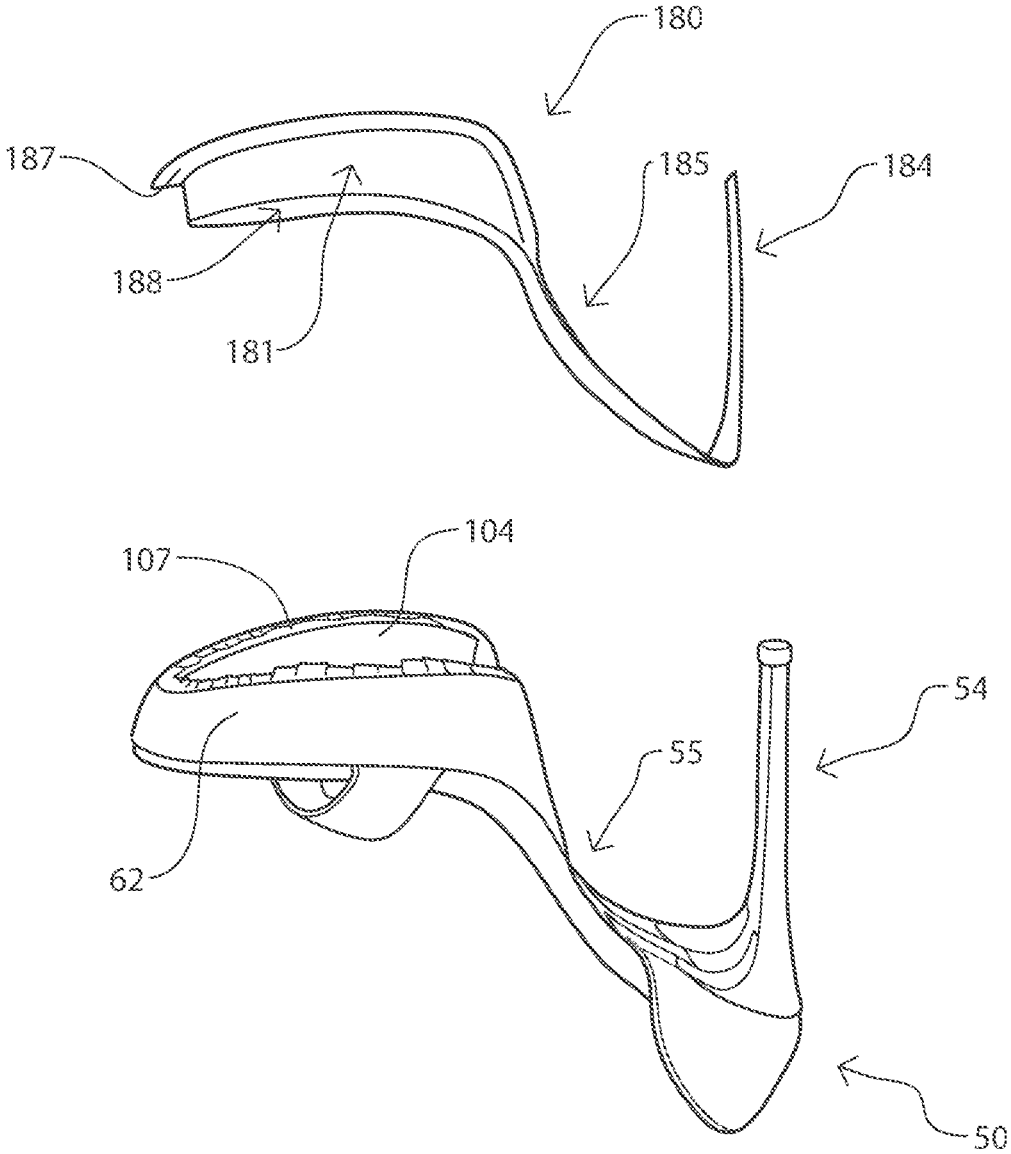
FIG. 19 is an expanded side perspective view of the construction of a shoe of the present invention incorporating the construction unit and of an encasement corresponding to the shape of the bottom of the shoe to be received by the body inner roof surface, the inner surface of the weight-bearing wall, the arch, the inner heel, and the bottom boundary.

In an aspect of the invention shown in FIG. 18, an additional outsole portion, protective sole cover 173, is fixedly attached to the bottom surface of an encasement or of bottom boundary 107. The bottom of the protective sole cover 173 may be textured, smooth, or grooved to form a tread 171. The protective sole cover 173 may be formed of a rubber or rubber-like material, may be formed of a slip-resistant material to add grip strength, or may be formed of other conventional outsole materials. The protective sole cover 173 may cover all or a portion of the bottom boundary 107. If only a portion of the bottom boundary 107 is covered, a concavity (within the bottom boundary 107) may form a concave channel 179 sized and shaped to receive the protective sole cover 173 with a rim 178 of the bottom boundary 107 remaining at the edge of the protective sole cover 173. Though FIG. 18 shows the rim 178 on the interior of the protective sole cover 173, in another aspect the rim 178 is disposed on the exterior of the protective sole cover 173.

Figure 12:
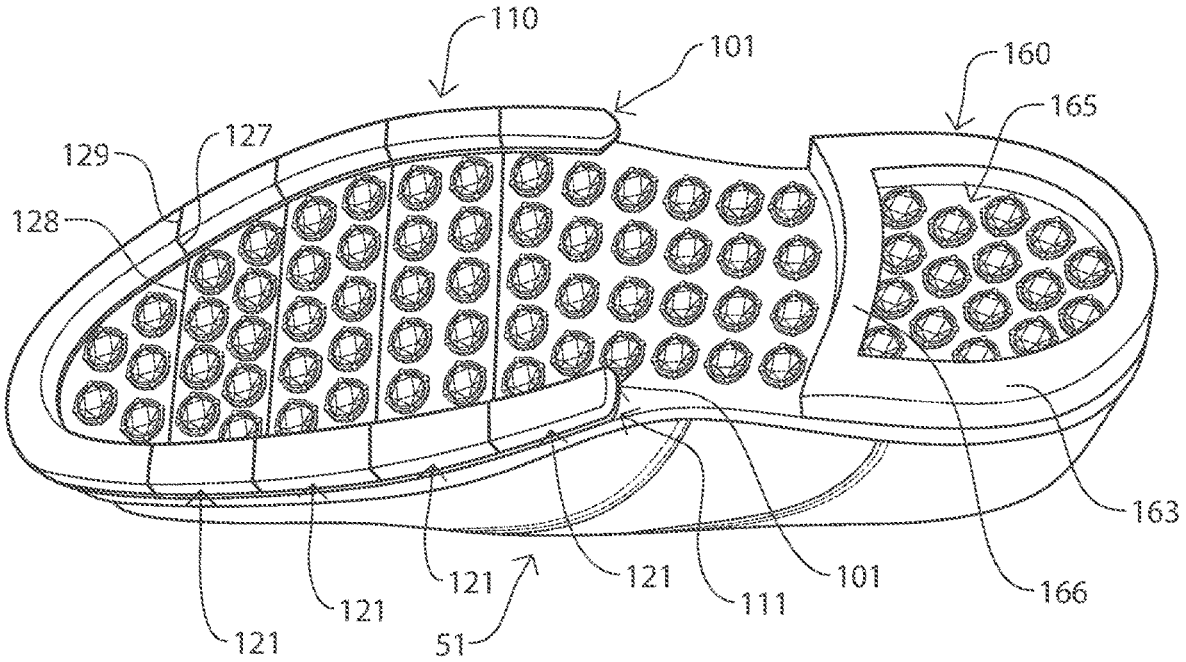
FIG. 12 is a bottom perspective view of a low-heeled or flat-heeled embellished shoe of an embodiment of the present invention having both a toe construction unit and a heel construction unit.
Figure 13:
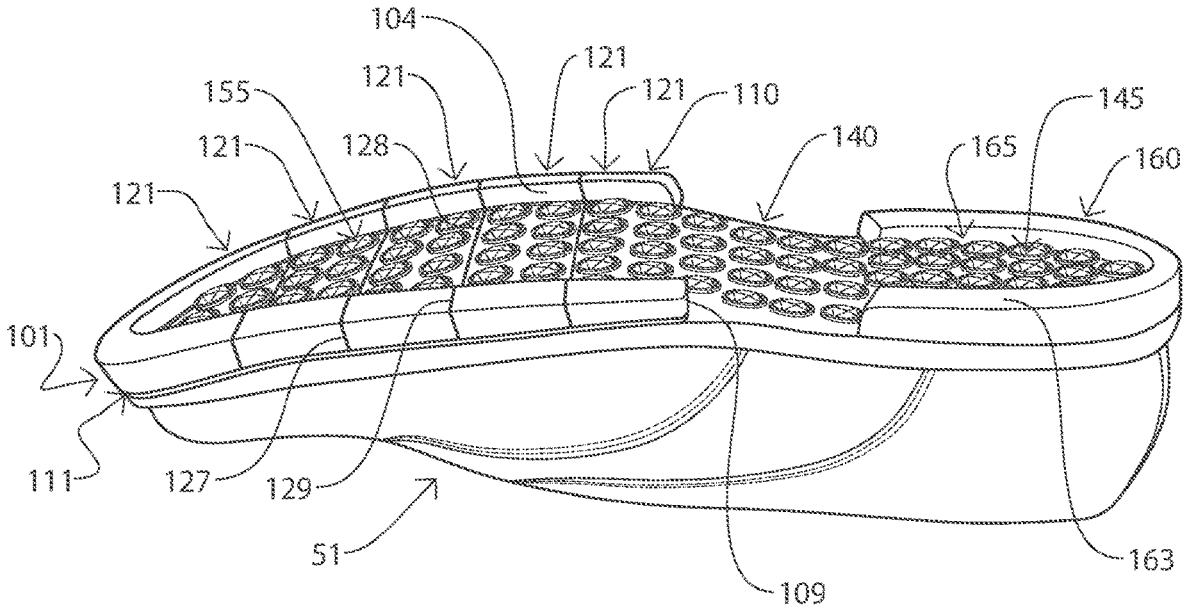
FIG. 13 is a side perspective view of flat-heeled embellished shoe of an embodiment of the present invention with both a toe and heel construction unit.

FIGS. 12-13 illustrate the second embodiment in which an open-back toe construction unit 110 is disposed on the toe of a flat shoe and in which a second construction unit, a heel construction unit 160, is disposed on the heel of a flat shoe. The heel construction unit 160 may be closed (as seen in FIG. 12) or may correspond to the toe construction unit no and be open, as in FIG. 13. (The heel construction unit 160 is not discussed separately, as it corresponds to the described toe construction unit, though in a different spatial orientation.) In FIG. 12, the closed construction unit 160 is disposed on the heel section of the shoe and the open-back construction unit 110 is disposed on the toe section of the shoe. In FIG. 13 two open-back construction units 110 are used (one disposed on the toe and one on the heel). In another aspect, two closed construction units 160 may be used (one disposed on the toe and one on the heel). In a further aspect, the open-back construction unit 110 may be disposed on the heel section and the closed construction unit 160 may be disposed on the toe section.

The closed heel construction unit 160 comprises at least a full or partial arcuate wall 163 and a full or partial transverse wall 166. In an aspect of the invention, the arcuate wall 163 and the transverse wall 166 are fixedly attached to the body 111 that is then attached to the upper 51 or to the midsole disposed below the upper 51. In this aspect, an upraised region 165 is an open space defined by the inner curved sides of the arcuate wall 163, the inner side of the transverse wall 166, and an upraised region top surface. The closed upraised region 165 is configured to receive the decorative element.

Though the heel construction unit 160 is illustrated as a short heel (around three-fourth inches in height), the closed construction unit may be implemented with much taller walls 163, 166.

In the second embodiment illustrated in FIGS. 12-13, both the upper unit body 111 and the weight-bearing wall 101 of the toe construction unit 11*o* are segmented to enhance the flexibility. Though in the first embodiment the weight-bearing wall 101 and the body 111 are preferably formed unitarily by molding, in this embodiment the weight-bearing wall 101 and the body 111 are formed in segmented members 121. Each segmented member 121 includes a segment of the wall 101 and a segment of the body 111. Adjacent segmented members 121 are separated by a horizontal gap 129 between the wall bottom surfaces of adjacent segmented members 121, a vertical gap 127 along the inner wall surface 104 (FIG. 13) between adjacent segmented members 121, and a horizontal gap 128 between the upper body 111 of adjacent segmented members 121. Having two or more segmented members 121 may provide an advantage to some shoes in that the segments increase the flex or bend of the portion of the sole to which they are applied. However, the segmented members 121 may be utilized by shoe designers for aesthetic reasons on other shoes that do not need the flexing functionality.

FIGS. 14-17 illustrate an aspect in which a sloped or inclined back wedge 117 at the rear of the construction unit 110 tapers to a very thin back edge 122. This allows a very smooth transition between the construction unit 110 and the arch, which may have both functional and aesthetic advantages.

Figure 16:
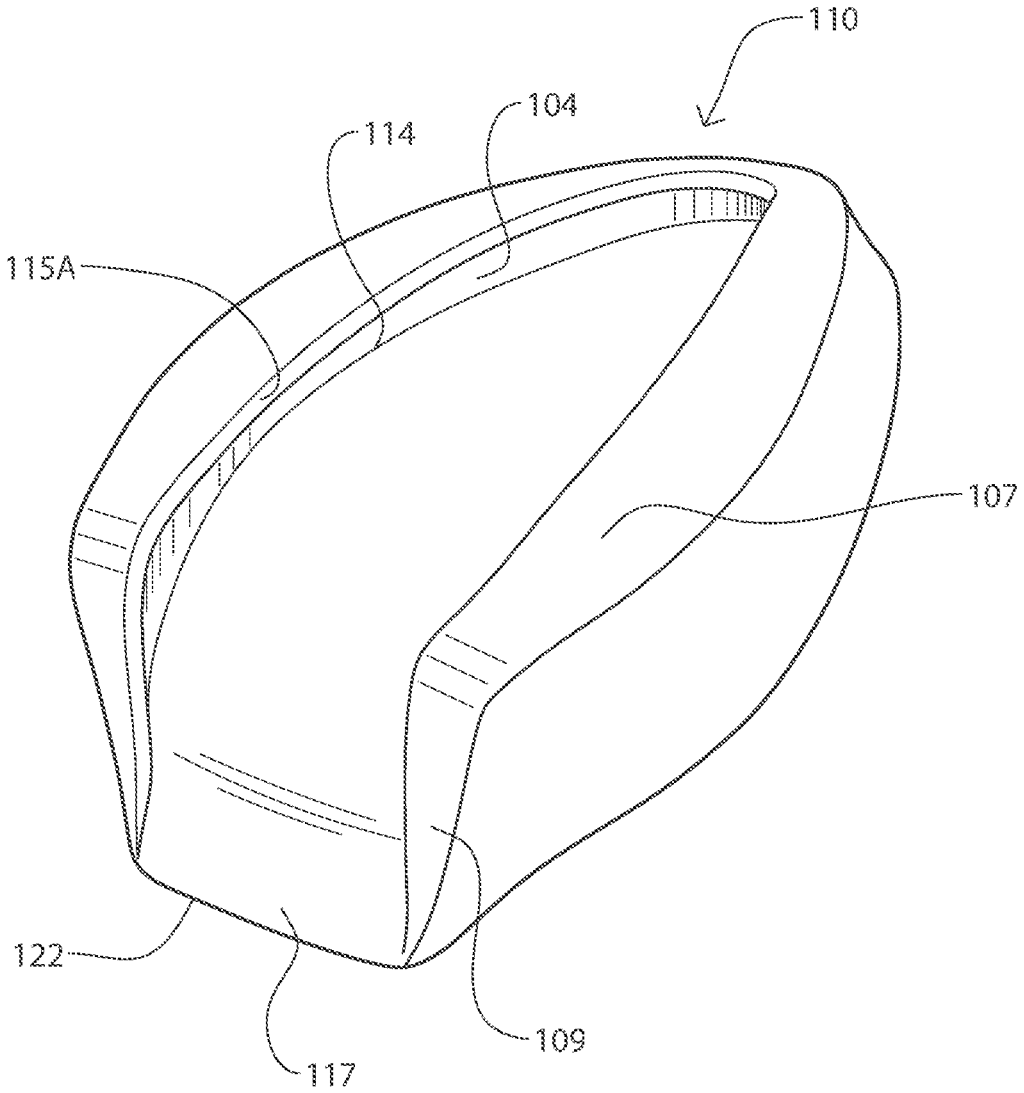
FIG. 16 is a perspective back view of the bottom of the construction unit of the present invention with a weight-bearing wall terminating in tapering right and left back wall margins.
Figure 17:
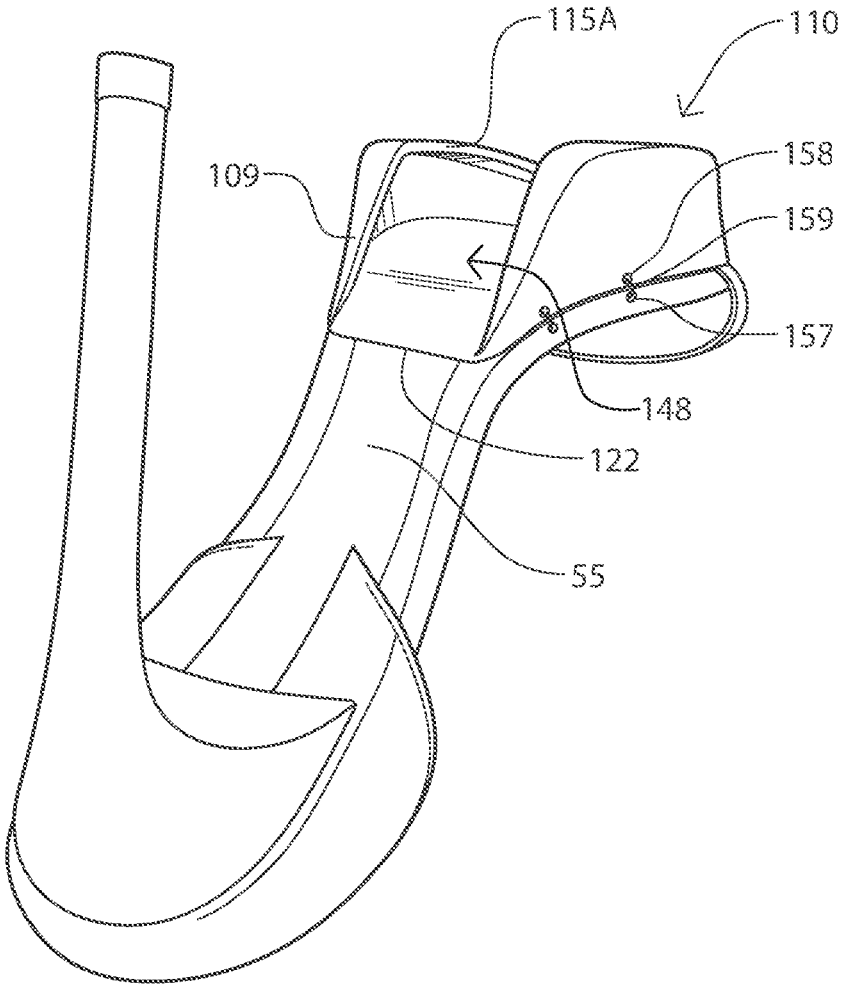
FIG. 17 is a perspective view of the bottom of a shoe of the present invention under construction that incorporates a toe construction unit having a weight-bearing wall terminating in tapering right and left back wall margins.

FIGS. 15-17 illustrate an aspect in which the center of the bottom boundary 107 has a greater thickness than the front or the rear of the bottom boundary 107, which may be advantageous in providing traction and walking stability. The right and left peripheral back margins 109 may be somewhat thinner in thickness than the middle of the bottom boundary 107 and may be generally uniform in thickness, as in FIG. 15, or may taper to a narrow V-shape, as illustrated in FIGS. 16-17. The narrow V-shape may allow easier viewing of the interior decorative component 150.

FIGS. 15-16 also illustrate a weight-bearing wall 101 that has a narrow width at the front, from wall outer edge 149 to wall inner edge 141. The inner wall is substantially vertical. This is in contrast to the aspect show in FIGS. 25-26 in which the front of the weight-bearing wall 101 has a wide width from wall outer edge 149 to wall inner edge 141. And, additionally, in FIG. 26 the inner wall is not substantially vertical, but it is instead inset (such as to form a smooth concavity or grotto). Thus, the inner and outer surfaces of the wall 101 may be generally parallel (as in FIG. 15) or may not be parallel (as in FIG. 26). And the width of the wall may be thin or thick. When the wall width is thin, a larger surface area of the body inner roof surface 119 is available for receiving decorative elements. When the wall is thicker, it may provide more traction, but reduces the area of the body inner roof surface 119 available for receiving decorative elements.

FIG. 17 illustrates the very smooth transition between the construction unit 110 and the arch area 55 that can be achieved when the back of the construction unit 110 is tapered into the wedge 117 ending at edge 122, as illustrated in FIGS. 15-18. The shoe under construction in FIG. 17 is shown before an outer covering (such as leather, imitation leather, or cloth) is disposed along the outer side and front surfaces of the construction unit 110 and the toe portion of the midsole to provide a consistent, elegant look. Additionally, to finish the manufacture of the shoe in FIG. 17, an encasement 180 (FIG. 19) may be applied to any or all of the upraised area 105, the wedge portion 117, and the arch portion 55; and then a decorative component 150 may be applied to the outside of the encasement 180 or may be integrated into the encasement 180.

FIGS. 19-24 illustrate a third embodiment of the invention that further discloses an encasement 180, where the encasement 180 conforms to the bottom portion of the shoe to give a polished, refined look. The use of the encasement 180 enables the multiple portions of the construction unit and shoe bottom portions to be smoothly covered and enhanced, which is comparable to the finished look achieved by using material to cover the parts of the upper to give a smooth, finished look. The encasement 180 may coordinate or contrast with the upper, based substantially on fashion and aesthetic concerns.

The encasement 180 comprises at least a recess roof encasing portion 188 (FIGS. 20, 23), and preferably also comprises one or more of a recess wall encasing portion 181, an arch encasing portion 185, a heel breast encasing portion 184, and an underside encasing portion 189. The recess roof encasing portion 188 is sized and configured to fit over and, in the finished shoe, to be fixedly attached to the body inner roof surface 119. The recess wall encasing portion 181 is sized and configured to fit over and, in the finished shoe, configured to have its inward-facing surface fixedly attached to the outer surface of the peripheral inner wall 104. The inner heel encasing portion 184 is sized and configured to fit over and, in the finished shoe, configured to have its inward-facing surface fixedly attached to the outer surface of the inner heel breast 63. The arch encasing portion 185 is sized and configured to fit over and, in the finished shoe, configured to have its inward-facing surface fixedly attached to the outer surface of the bottom or arch 55. The underside encasing portion 189 is sized and configured to fit over and, in the finished shoe, configured to have its inward-facing surface fixedly attached to the surface of the bottom boundary 107. Specifically, the inner side 187 (FIG. 19) of underside encasing portion 189 is fixedly attached to the outside of the bottom boundary 107. As shown, the underside encasing portion 189 may be configured with irregularities 171 (FIG. 20), such as grooves or texturing, to increase traction and facilitate walking stability. In an aspect, the underside encasing portion 189 may be configured with an inset that covers a portion of the bottom boundary 107. For example, if the encasement 180 is formed of a precious metal, a thermoplastic insert within the underside encasing portion 189 may be included to slightly elevate the precious metal to avoid wear. The insert may be replaceable. In an aspect the underside encasing portion 189 may comprise multiple layers with an inner decorative layer and an outer wearable layer, such as a thin transparent synthetic stratum.

The encasement 180 may be formed in parts and fixedly joined together or may be formed unitarily, such as by molding. The encasement 180 may be a thin skin to enhance the finished look or may be thicker to provide cushioning and/or to facilitate attachment of the decorative component 150. In one aspect the encasement 180 is formed of thermoplastic. In another aspect the encasement 180 is formed of metal.

Figure 2A:
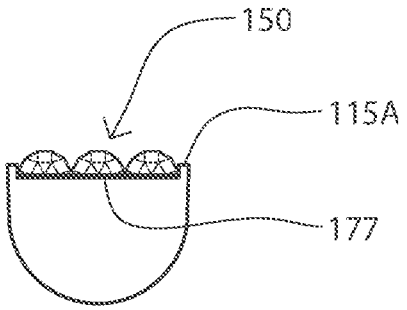
FIG. 2A is a cut view taken from line 2A-2A of FIG. 2 of the embellished shoe of the present invention.

In the finished shoe, the decorative component 150 is received by, and disposed within, the upraised area 105 and is directly or indirectly attached to at least one of the inner surface of the inner wall 104 or the body inner roof surface 119. One method of indirect attachment is through the use of an encasement 180. Another method of indirect attachment is shown in FIG. 2A where the decorative component 150 is carried by a substrate 177, which may be formed by an inlay 172 that is fixedly attached to the encasement 180. In another method of direct or indirect attachment of the decorative component to the surface of the inner wall 104 or the body inner roof surface 119, the decorative component is formed integrally with the surface of the inner wall 104, the body inner roof surface 119 or an encasement or inlay covering the wall or roof surface.

Figure 20:
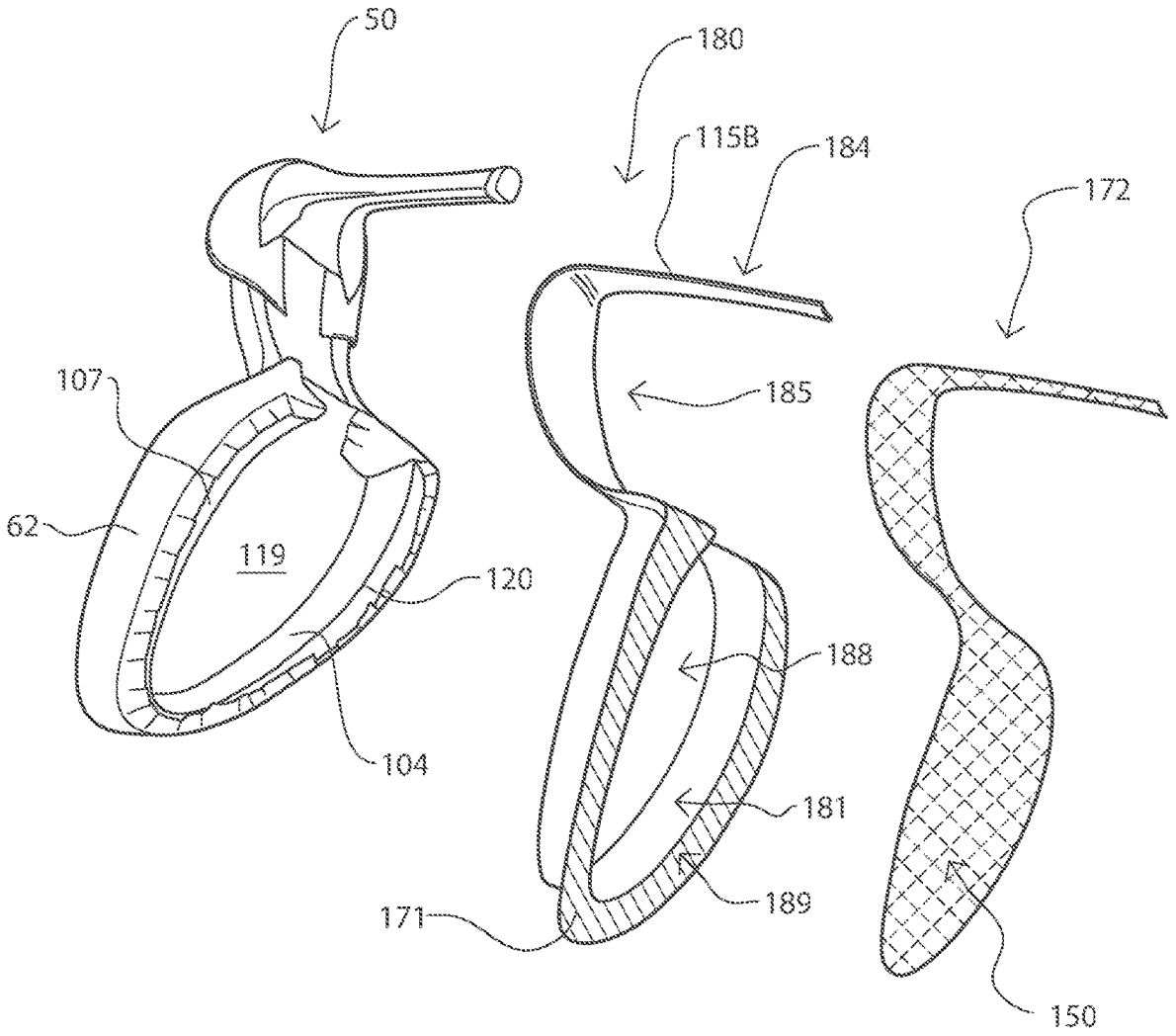
FIG. 20 is an expanded side perspective view of the construction of a shoe of the present invention incorporating the construction unit, an encasement corresponding to the shape of the bottom of the shoe, and an inlay corresponding to the shape of the body inner roof surface, the arch surface, and the inner heel surface.
Figure 21:
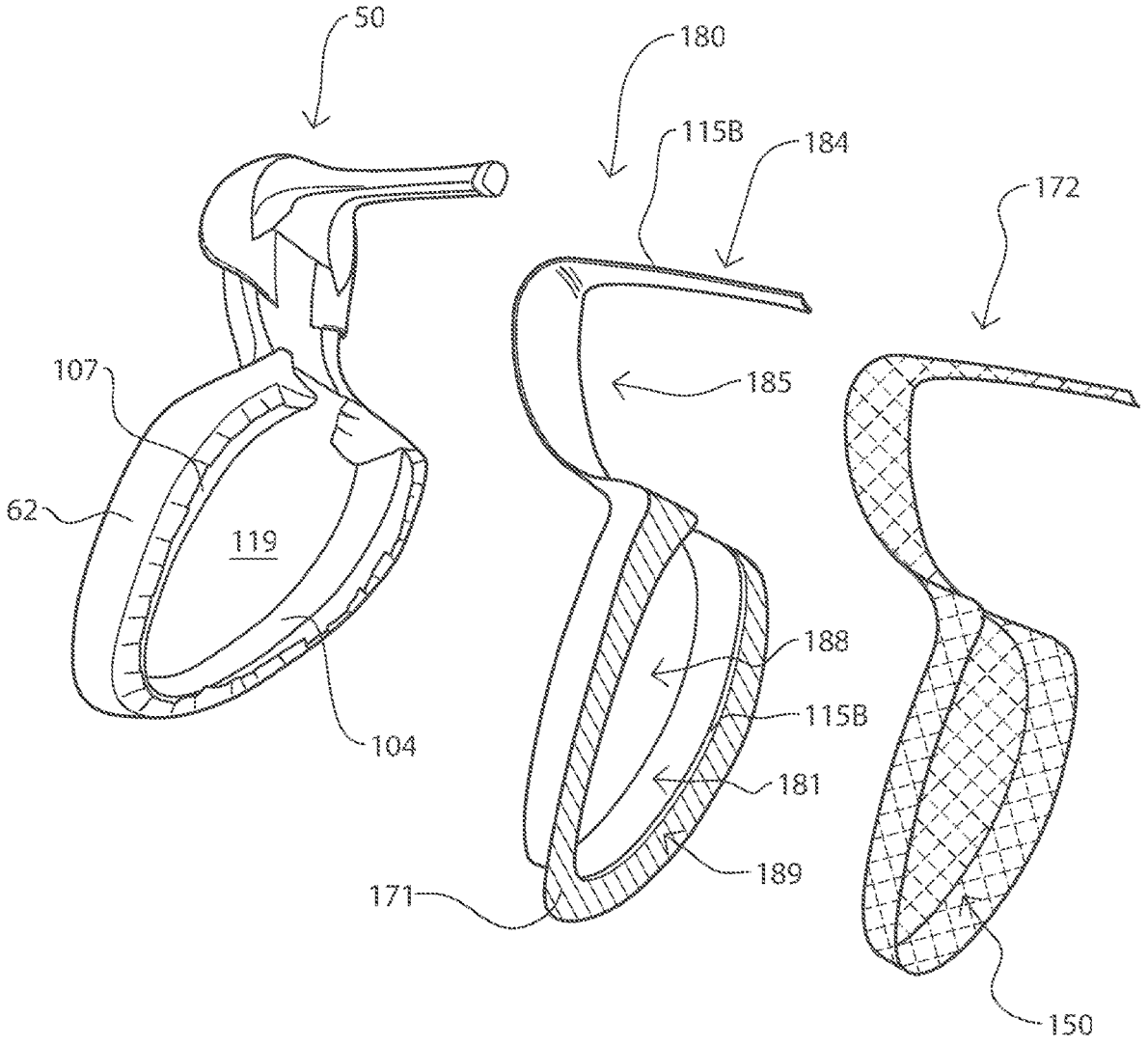
FIG. 21 is an expanded side perspective view of the construction of a shoe incorporating the construction unit, an encasement corresponding to the shape of the bottom of the shoe, and of an inlay corresponding to the shape of the body inner roof surface, the inner surface of the weight-bearing wall, the arch surface, and the inner heel surface.
Figure 24:
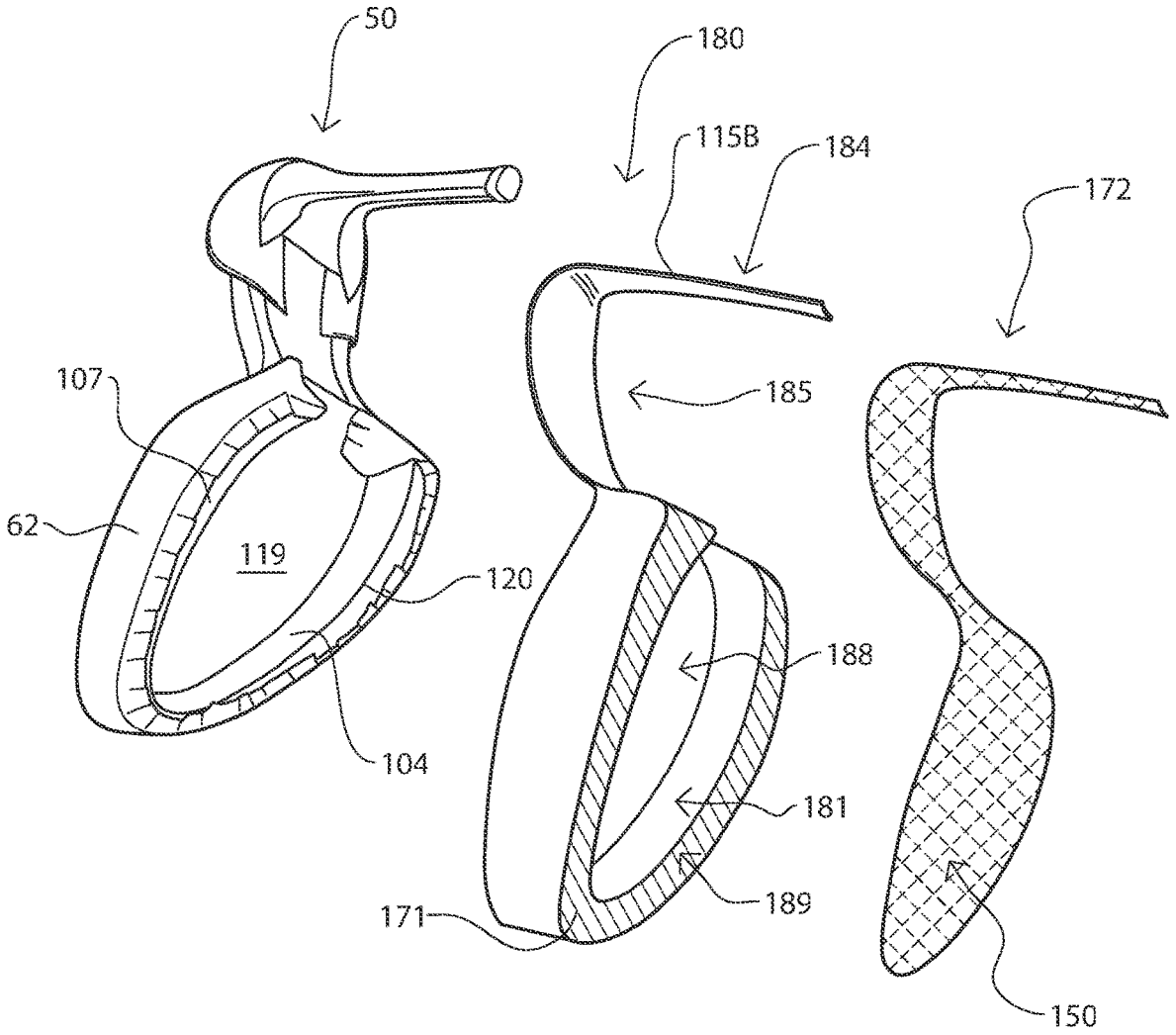
FIG. 24 is an expanded side perspective view of the construction of a shoe incorporating the construction unit, an encasement, and an inlay, wherein the encasement corresponds to the shape of the body inner roof surface, the inner surface of the weight-bearing wall, the arch, the heel breast, the bottom boundary, and the wall outer surface; and wherein the inlay corresponds to the shape of the body inner roof surface, the arch surface, and the heel breast surface.

In one aspect, an inlay 172 may be large to substantially cover the entire area of the upraised area 105, arch bottom surface, and heel inner surface, as seen in FIG. 21. In a further aspect, the inlay 172 may be larger to substantially cover the entire area of the upraised area 105, arch bottom surface, heel inner surface, and the toe platform 62 as seen in FIG. 24. In another aspect, the inlay 172 may only cover a portion of the upraised area 105. In another aspect, the inlay may cover only the body inner roof surface 119 or the inlay may cover only the recess roof encasing portion 188 that covers the body inner roof surface 119. In another aspect, as seen in FIG. 20, the inlay 172 may cover the body inner roof surface 119 (or the recess roof encasing portion 188 that covers the body inner roof surface 119), the arch bottom surface, and heel inner surface. The inlay 172 corresponds generally in shape to the portions to be covered. In one aspect inlay 172 may be formed of a flexible material that has a degree of elasticity or adjustability to enable to inlay 172 to be applied smoothly.

Figure 22:
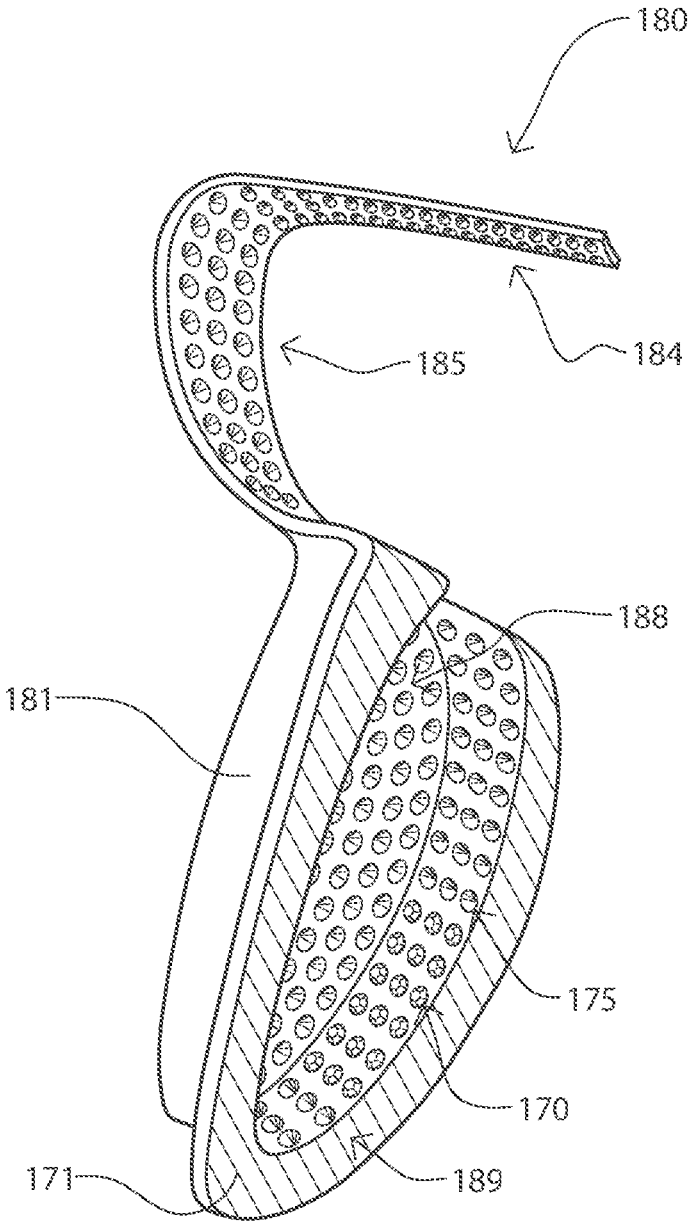
FIG. 22 is a bottom perspective view of an encasement of the present invention configured to receive decorative elements with some decorative elements installed.

Though FIG. 22 shows a single type of decorative component for fixedly attaching to the recess roof encasing portion 188, the recess wall encasing portion 181, the arch encasing portion 185, and the inner heel encasing portion 184, there is no requirement that a single type of decorative component be used. As dictated by fashion, aesthetics, and functionality, multiple types of decorative components may be used. For example, if sharp spikes are attached to the recess roof encasing portion 188, metal studs may be attached to the other portions of the outer portion of the encasement 180. Or in a second example, rhinestones may be attached to the recess roof encasing portion 188, the arch encasing portion 185, and the inner heel encasing portion 184 with sequins attached to the recess wall encasing portion 181. The thickness of the encasement 180 may be based on the type of decorative component 150 that will be attached, as well as aesthetic and functional concerns.

FIGS. 25-26 illustrate the aspect of the invention having a weight-bearing wall 101 with a front portion that is thicker than the front portion of the weight-bearing wall 101 in earlier embodiments. This thickened front portion creates an expanded front portion of the bottom boundary 107. The expanded front portion of the bottom boundary 107 provides a variation in the design and a larger surface area for walking. The expanded bottom boundary 107 allows the inner surface 104 of the weight-bearing wall 101 to be vertical (FIG. 25) or inset (FIG. 26). The inset inner surface 104 allows for an undercut to form a cavern-like upraised area 105.

FIGS. 11, 14, 27, 28 illustrate that the weight-bearing wall 101 need not be solid, but can be configured with one or more cut-throughs, holes, latticework, slits, or the like with the limitation that the weight-bearing wall 101 retains sufficient robustness to bear the weight of the wearer.

Figure 11:
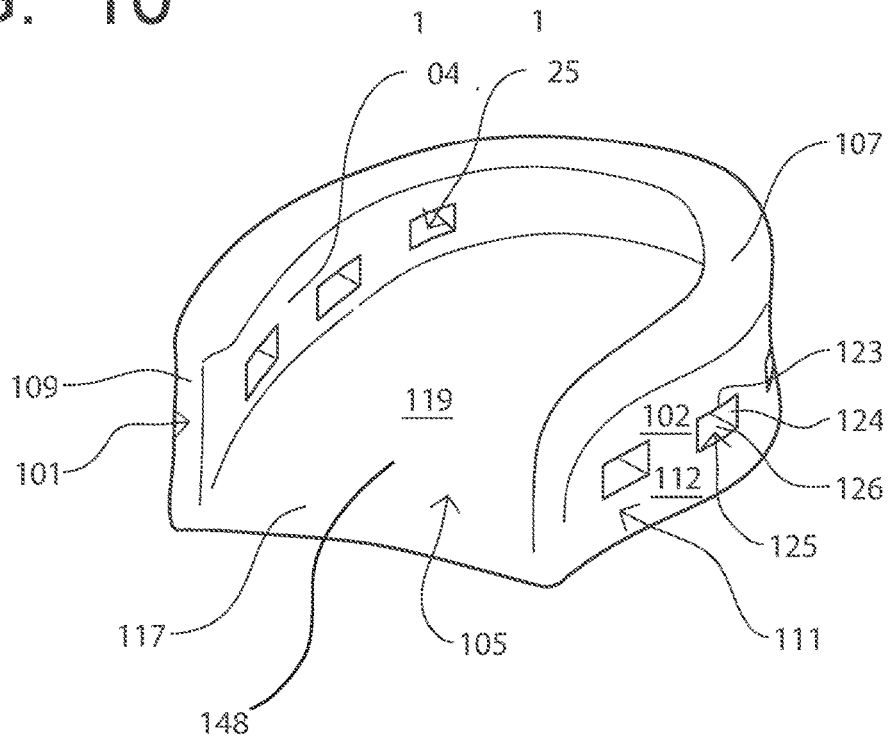
FIG. 11 is a bottom rear perspective back view of a construction unit of the present invention with a weight-bearing wall including apertures.

FIG. 11 illustrates an aspect of the invention in which there are one or multiple openings 125 within the weight-bearing wall 101. Each opening is defined by a top frame 126, a bottom frame 123, and opposing side frames 124. The opening or openings 125 may serve as a type of window allowing a viewer to catch glimpses of the decorative component 150. The opening or openings 125 may also reduce the weight of the construction unit 110 but can be designed in such a manner as to minimize the reduction in strength.

Figure 14:
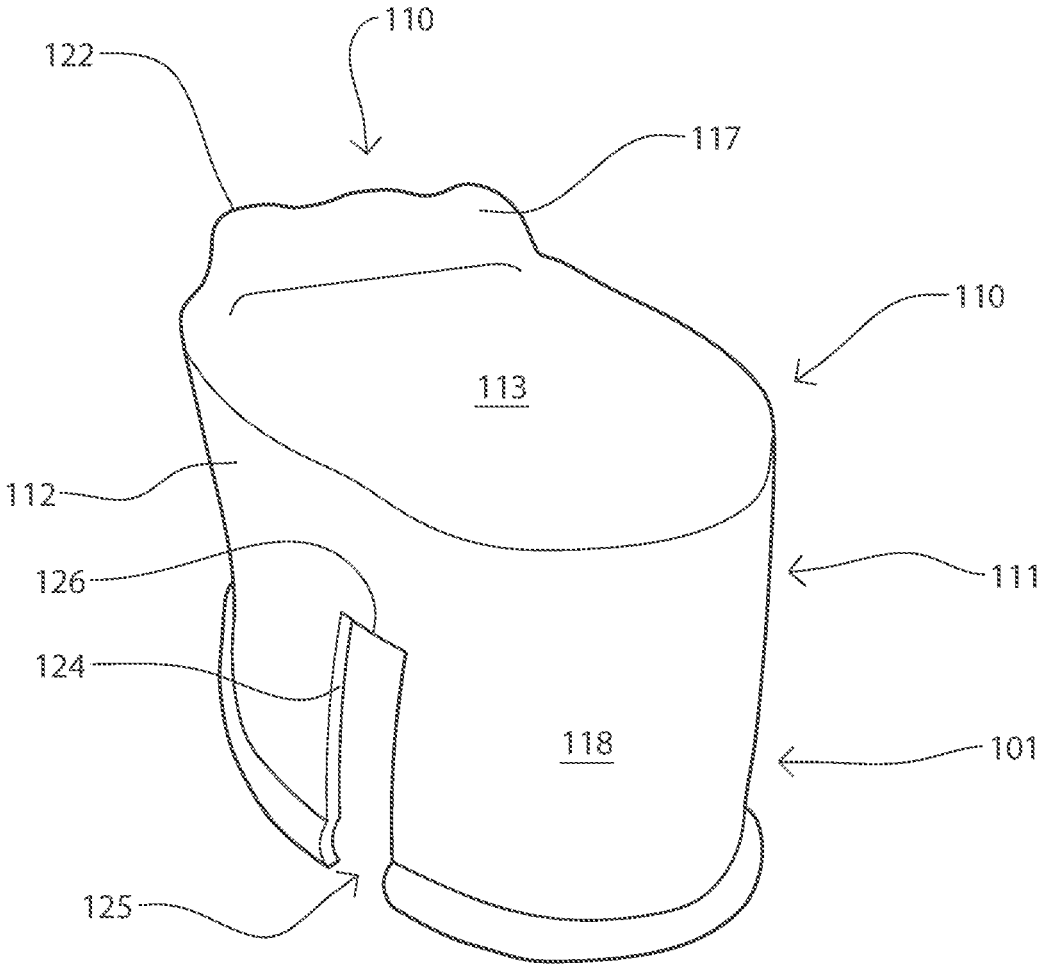
FIG. 14 is a front top perspective view of the toe construction unit of the present invention having a multi-section, discontinuous, partial weight-bearing wall.

FIG. 14 illustrates a slot-type opening 125 in the weight-bearing wall 101 that provides another means for a viewer to view the interior decorative component 150. The slot-type opening 125 is defined by side frames 124 and a top frame 126.

Figure 27:
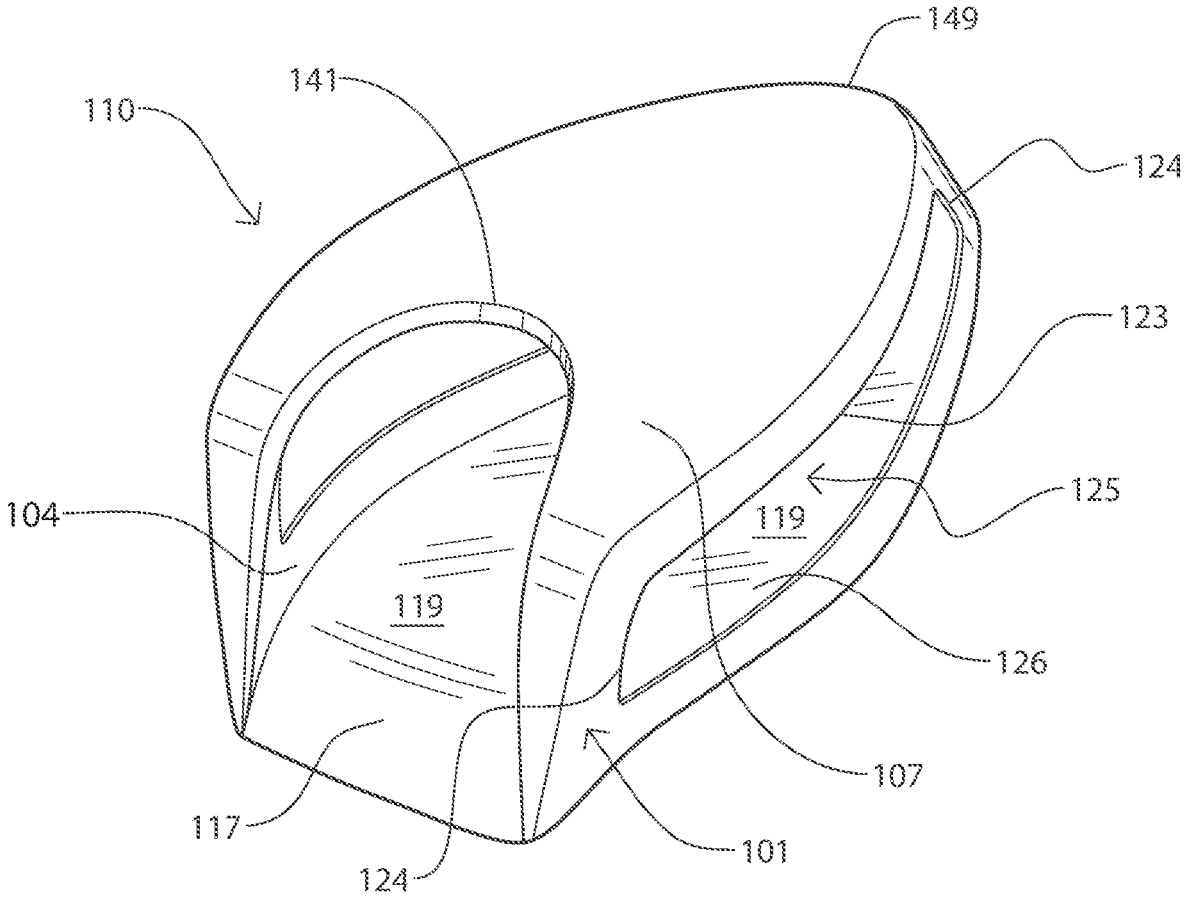
FIG. 27 is a perspective back view of the bottom of the construction unit of the present invention having a bottom boundary spanning a portion of the area between the opposing unit sides to form a grotto within the construction unit and having large cutouts in opposing sides of the weight-bearing wall.

FIGS. 27-28 illustrate a fourth embodiment in which the upraised are 105 is aa grotto-like cavity with a grotto floor 108 spanning the area between the opposing side walls 101.

This embodiment adds another area that can receive a decorative component 150. In the first embodiment, there is a possibility of applying a decorative material or embellishment 150 to any or all of the body inner roof surface 119, the inner surface 104 of wall 101, the wedge 117, the back rearward surface 148 of the unit body 111, the arch 55, and the heel breast 63. This fourth embodiment adds another area to which a decorative component 150 may be applied, and this is the grotto floor surface 108. When the grotto-type construction unit 110 and decorative component 150 are installed into an embellished shoe 100, a viewer may glimpse the decorative component disposed on the body inner roof surface when the wearer's legs are crossed, but then, when the wearer changes the angle of the foot, the viewer may glimpse the decorative component disposed on the grotto floor 108. At various angles, any decorative component disposed on the inner wall 104, the wedge 117, the back rearward surface 148 of the unit body 111, the arch 55, and the breast 63 of the heel 53 may be viewable.

The interior of the grotto is viewable from the back (FIGS. 26, 27, 28) or through either of the two openings 125 disposed on opposing sides of the outer wall 101 in FIGS. 27, 28. Each of the openings are defined by a top frame 126 at the level of the unit body inner roof surface 119, a bottom frame 123 at the level of the horizontally extending grotto floor 108, and a set of side frames 124. The open space within the grotto is defined by the side opening 125 frames, a front and two back portions of the wall 101, grotto floor 108, and body inner roof surface 119.

The top frame 126 is disposed at the top of the side opening 125. It may be aligned with the unit body inner roof surface 119 to form a smooth transition.

The bottom frame 123 is disposed at the bottom portion of the side opening. The front portion of the bottom frame 123 is at the level of and contiguous with a floor 108, which extends horizontally between the two opposing sides of a portion of the weight-bearing outer wall 101.

More specifically, in the aspect of the invention that is illustrated, the floor 108 extends horizontally side-to-side between the bottom frame 123 of one side opening 125 to the bottom frame 123 of the opposite side opening 125. The floor 108 extends horizontally front-to-back from the inner surface 104 (FIG. 15) of the front portion of wall 101 to the rearmost grotto floor edge, which is also the bottom boundary inner edge 141. In another aspect of the invention, the floor 108 extends horizontally side-to-side between the opposing sides of the inner surface 104 (FIG. 15) of the wall 101 and extends horizontally front-to-back from the inner surface 104 (FIG. 15) of the front portion of wall 101 to the rearmost grotto floor edge at bottom boundary inner edge 141, but it is not disposed at the level of the bottom frame 123.

In the first embodiment, the body top portion surface 119 is at an upper first level, the body inner roof surface is at a second level below the first level, and the bottom boundary is at a third level adjacent to the ground and below the second level. This fourth embodiment adds a fourth level, which is the level of the grotto floor 108. The fourth level is above the third level, but below the second level. Though one or more of the levels may be planar, there is no requirement for this, and, in most cases, the levels will not be planar.

In the first embodiment the decorative component 150 attached to the body inner roof surface 119 has a height less than the height of the inner wall surface 104, which elevates the decorative component 150 above the ground. In the fourth embodiment, the decorative component 150 attached to the body inner roof surface 119 (the roof of the grotto) will typically have a vertical height less than the vertical distance between the body inner roof surface 119 and the grotto floor 108.

Figure 29:
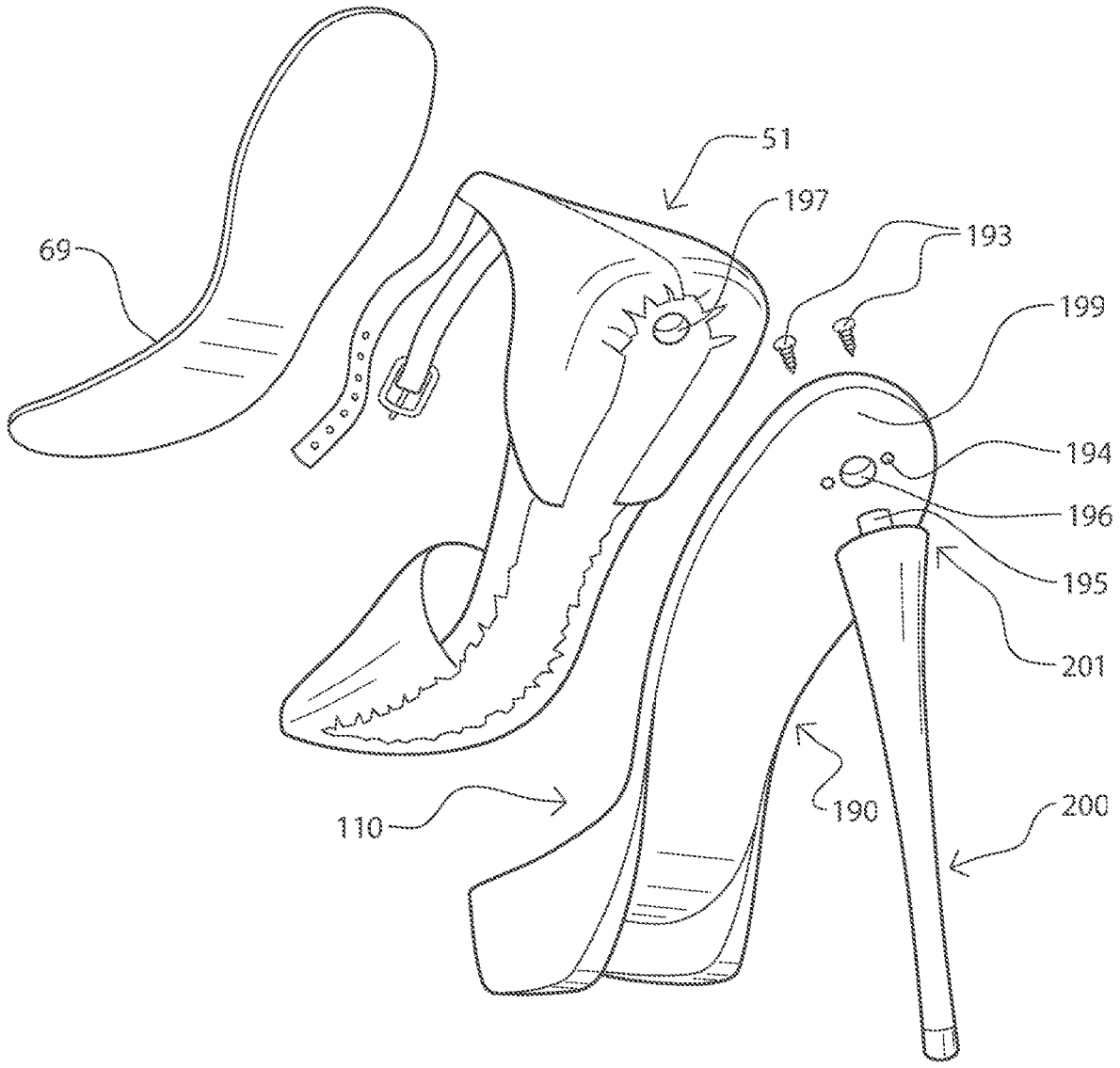
FIG. 29 is a perspective back view of an aspect of the inventive construction unit having an elongated ramp (including an arch extension and a heel extension), which is shown with a first exemplary small-base heel.
Figure 30:
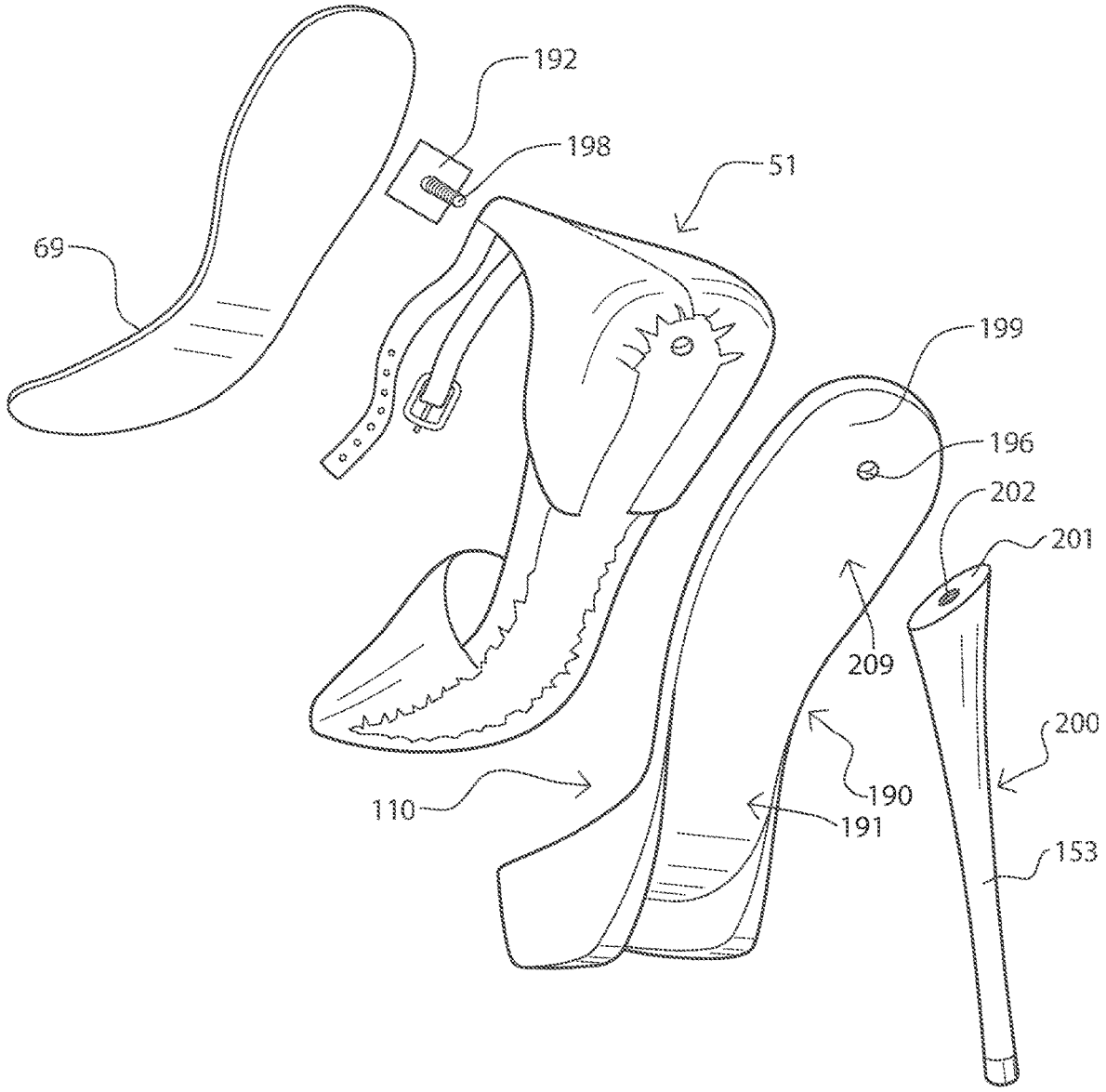
FIG. 30 is a perspective back view of an aspect of the inventive construction unit having an elongated ramp (including an arch extension and a heel extension), which is shown with a second exemplary small-base heel.

The fifth embodiment of the invention is shown in FIGS. 29-30. The fifth embodiment provides a construction unit 110 that is lengthened or extended to include not only the toe construction unit portion already described, but to also include an arch extension 191 and a heel extension 209. Thus, the construction unit 110 is not limited to ending at the back area of the shoe toe, such as at the wedge back edge 122 (as seen in FIGS. 3, 17), but it may extend as an elongated ramp to cover the entire shoe base. In this embodiment, the unit body 111 begins at the shoe toe area (which carries the weight-bearing wall 101), extends past the toe area to the arch area (as arch extension 191), and further extends past the arch area to end at the distal heel area (as heel extension 209). In an aspect, the elongated construction unit is formed unitarily for strength.

Also shown in FIGS. 29-30 is an added area at the bottom of a shoe that can be utilized to display a portion of the decorative component 150. In this aspect, a shoe heel 200 with a small base 201 is fixedly attached to the shoe. The use of a smaller base 201 than is typical for the heel permits the area around the heel, the perimetric margin 199, to additionally be available for receiving the decorative component 150. The perimetric margin 199 is a flat or gently curved area of the elongated construction unit around the base of the heel 200. Though the small-base heel 200 is illustrated with a tall vertical support portion 153, a medium or short vertical support portion 153 is within the scope of the invention.

The small-base heel 200 is fixedly attached to the shoe in any of the various ways known in the art of shoemaking. Two exemplary attachment means are shown in FIGS. 29 and 30. FIG. 29 shows a peg 195 that corresponds to a receiving aperture 196 disposed within the heel portion of the elongated construction unit. The peg 195 is inserted into the receiving aperture 196 (and may additionally extend into an aperture 197 of the upper) and may secured by adhesive and/or by mechanical devices 193, such as screws or monofilament, either of which may make use of the holes 194. FIG. 30 shows a second exemplary attachment means in which the heel 200 includes a concavity 202 aligned with an aperture 196 in the extended construction unit 190 and an aperture in a portion of the bottom of the upper 51. The heel 200 is attached mechanically and/or adhesively. For example, a bolt 198 (with a large head or base 192) may be installed to join the upper 51, the extended construction unit 190, and the heel 200. An insole 69 (and/or other inner shoe layers) may function to cover the base 192 of the mechanical attachment.

When the heel 200 is installed onto the finished shoe, the perimetric heel margin 199 exterior to the outer portion of the heel base 201 provides a foundation upon which the decorative component 150 may be directly or indirectly disposed. The decorative component 150 may be adhered directly to the perimetric heel margin 199, or the perimetric heel margin 199 may be covered by a suitable covering with the decorative component 150 fixedly attached to or adhered to the suitable heel covering. Thus, this aspect provides an additional area to which a decorative component 150 may be displayed.

In all the embodiments, the decorative component 150 is attached securely to the underlying surface. In some aspects, the decorative component 150 may be attached via glue, adhesive, or other bonding agent. In an aspect, the decorative component 150 may be further secured with threading extending from the underlying portion of the shoe and engaged with the decorative component 150. In an example show in FIG. 22, the decorative component is rhinestones or rhinestone-like stones 170 disposed within cone-shaped receiving holes 175 that may be held within the receiving holes 175 with glue, adhesive, or mechanical settings. In an aspect, a pavé-type setting may be used, in which multiple small stones, beads, or the like are closely set with minimal visibility of the metal prongs holding them in place to provide the look of a sparkly pavement.

Figure 23:
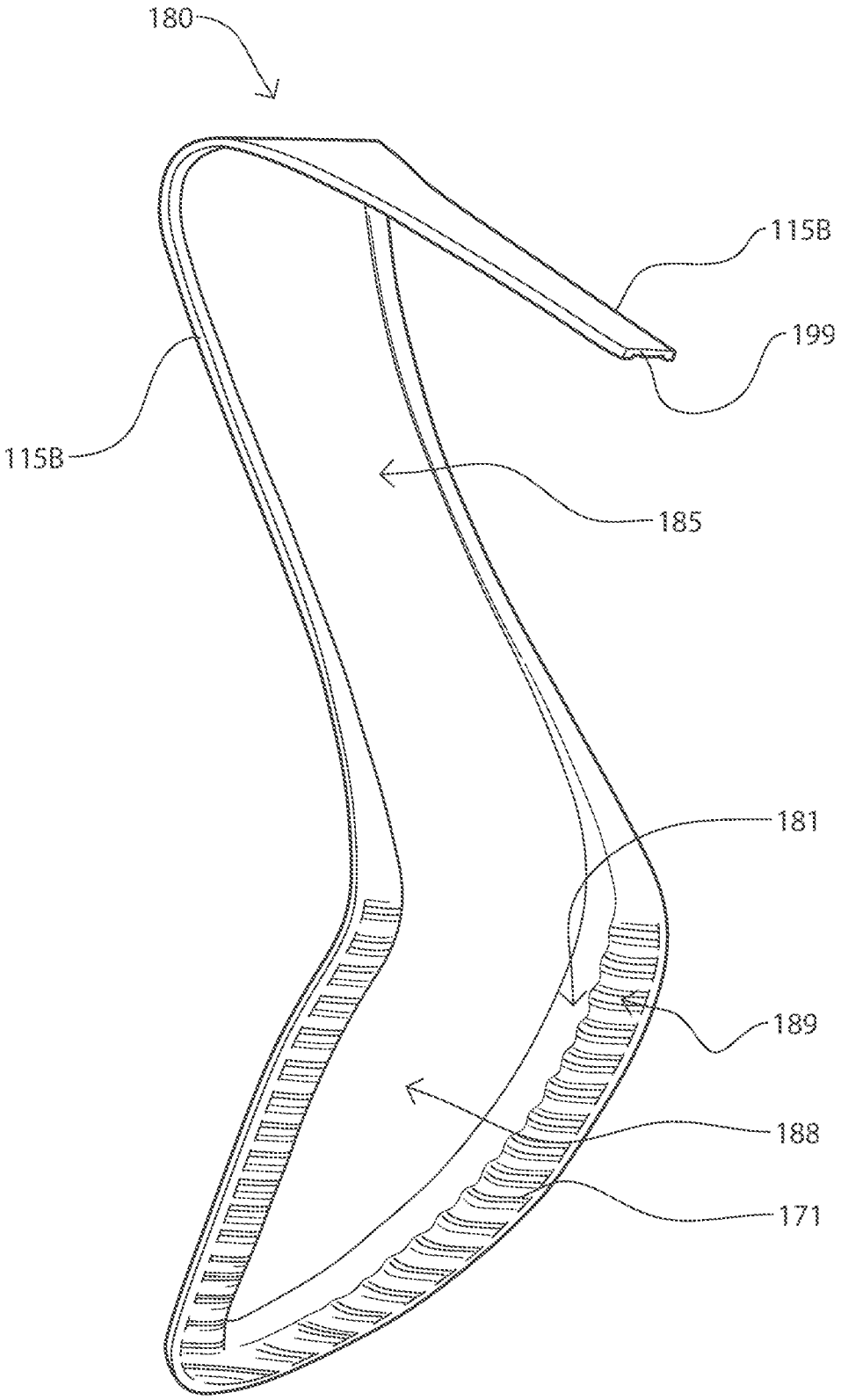
FIG. 23 is a bottom perspective view of an encasement of the present invention.

In the aspect in which the decorative component 150 is disposed on or integrated into the inlay 172, the edges of the decoration-receiving areas may include a border ridge 115 that is sufficiently deep to hide the inlay 172. The border ridge 115 is located to obscure viewing of the inlay edge, so it is disposed in a location that allows it to cover the inlay's raw edge when the inlay is installed. For example, without a border ridge 115, if the inlay 172 is disposed on the peripheral inner wall 104 or on the recess wall encasing portion 181 covering the peripheral inner wall 104, the edge of the inlay 172 could be seen at the bottom of the shoe. In one aspect, the inlay 172 is to be disposed on the recess roof encasing portion 188 and the recess wall encasing portion 181 of the encasement 180, so a border ridge 115B is disposed at the intersection of the underside encasing portion 189 and the recess wall encasing portion 181 to hide the edge of the inlay 172, as can be seen in FIG. 21. In an additional aspect shown in FIGS. 20, 23, when the inlay 172 is installed, it covers the recess roof encasing portion 188, which positions the edge of the inlay 172 adjacent to and/or abutting the recess wall 181; therefore, no border ridge 115 is needed or included at the junction of recess wall 181 and recess roof encasing portion 188. But as the inlay 172 extends across the arch and down the inner heel, a border ridge 115B is disposed along the outer edge of the arch encasing portion 185 and inner heel encasing portion 184 to hide the edge of the inlay 172. In one aspect as seen in FIG. 23, the border ridge 115B may run down both sides of the inner heel encasing portion 184 but may have an opening 199 at the end of the inner heel encasing portion 184, which may provide advantages in assembly.

In a further aspect in which no encasement is included, the arch and heel may include a border ridge 115A to obscure viewing of the edge of the substrate 177, as seen in FIG. 2A. FIGS. 16-17 illustrate an aspect of the construction unit 110 with a border ridge 115A, while FIG. 10 illustrates an aspect of the construction unit 110 without a border ridge 115A.

Figure 31:
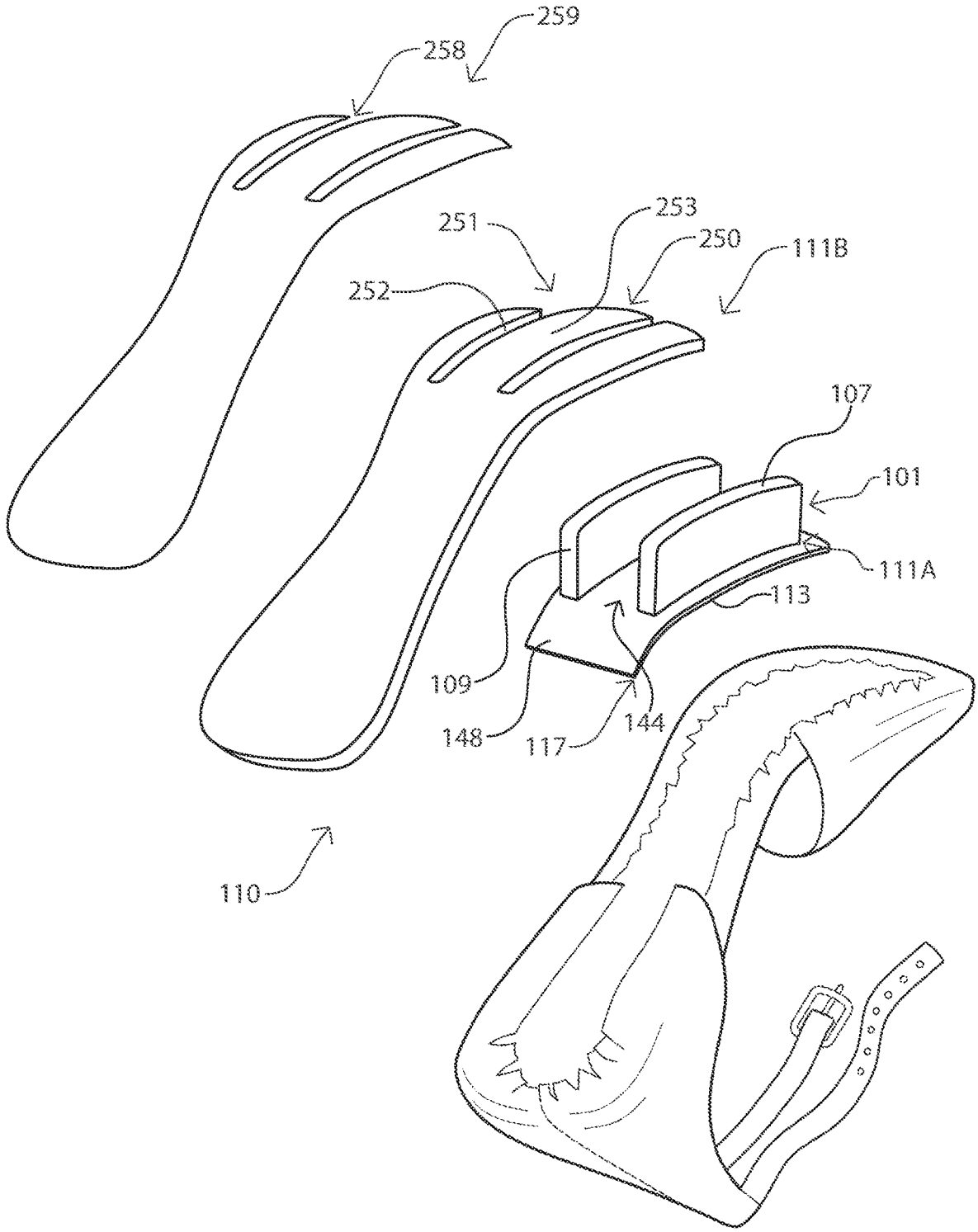
FIG. 31 is an expanded perspective back view of components of the shoe of the present invention, including a partial weight-bearing wall and a two-portion construction unit with inward and outward unit body portions.

FIG. 31 illustrates a sixth embodiment which provides another example of a partial wall 101, provides a construction unit no with a two-part unit body 111A, 111B, and provides a weight-bearing wall 101 that is slightly to somewhat inset from the periphery of the shoe.

Partial weight-bearing walls 101 may be used to meet design or aesthetic considerations with the limitation that they can support the weight of the user. Examples of partial walls 101 have been shown in FIGS. 11, 14, 27, and 28. In the partial wall 101 of FIG. 31, the opposing side walls support the weight of the user while the toe area of the wall has been mostly eliminated.

The portion of the unit body that is closer to the shoe upper, the inward unit body portion mA, will be fixedly attached to the shoe upper below the shoe toe box. The inward unit body portion 111A carries the weight-bearing wall 101, which may be full (not shown) or partial (as shown). The outward unit body portion 111B is configured with slits 251 defined by slit borders 252 that are sized and shaped to accommodate the weight-bearing wall 101. The slits 251 are fitted over the wall 101 with the outward unit body portion 111B then fixedly attached over the inward unit body portion 111A with the wall 101 extending through the outward unit body portion 111B at each side of a between-slit area 253 serving as a roof surface 119 when the shoe is complete. Thus, the height of the wall 101 must be a greater height than the height of the outward unit body portion 111B. Optionally, a finishing outsole 259, encasement, inlay, or the like (configured with outsole slits 258) may be attached to provide functional and aesthetic enhancements. In another option, the unit body portion 111B comprises a standard sole configured with slits 251 defined by slit borders 252. The wall 101 may be solid or configured with openings.

The portion of the unit body that is proximal to the shoe upper, the outward unit body portion 111B, may be formed of a rigid material or may be flexible or somewhat flexible. In most shoe designs, the toe front 250 of outward unit body portion 111B will substantially align with the toe front of the shoe upper to provide a smooth, integrated look.

FIG. 31 also illustrates that the weight-bearing wall 101 need not be disposed at the outer edge of the shoe, but all or part of it can be inset from the periphery. Though the toe of a shoe is not wide, the wall 101 may still be inset a small distance based on structural and aesthetic considerations.

Figure 32:
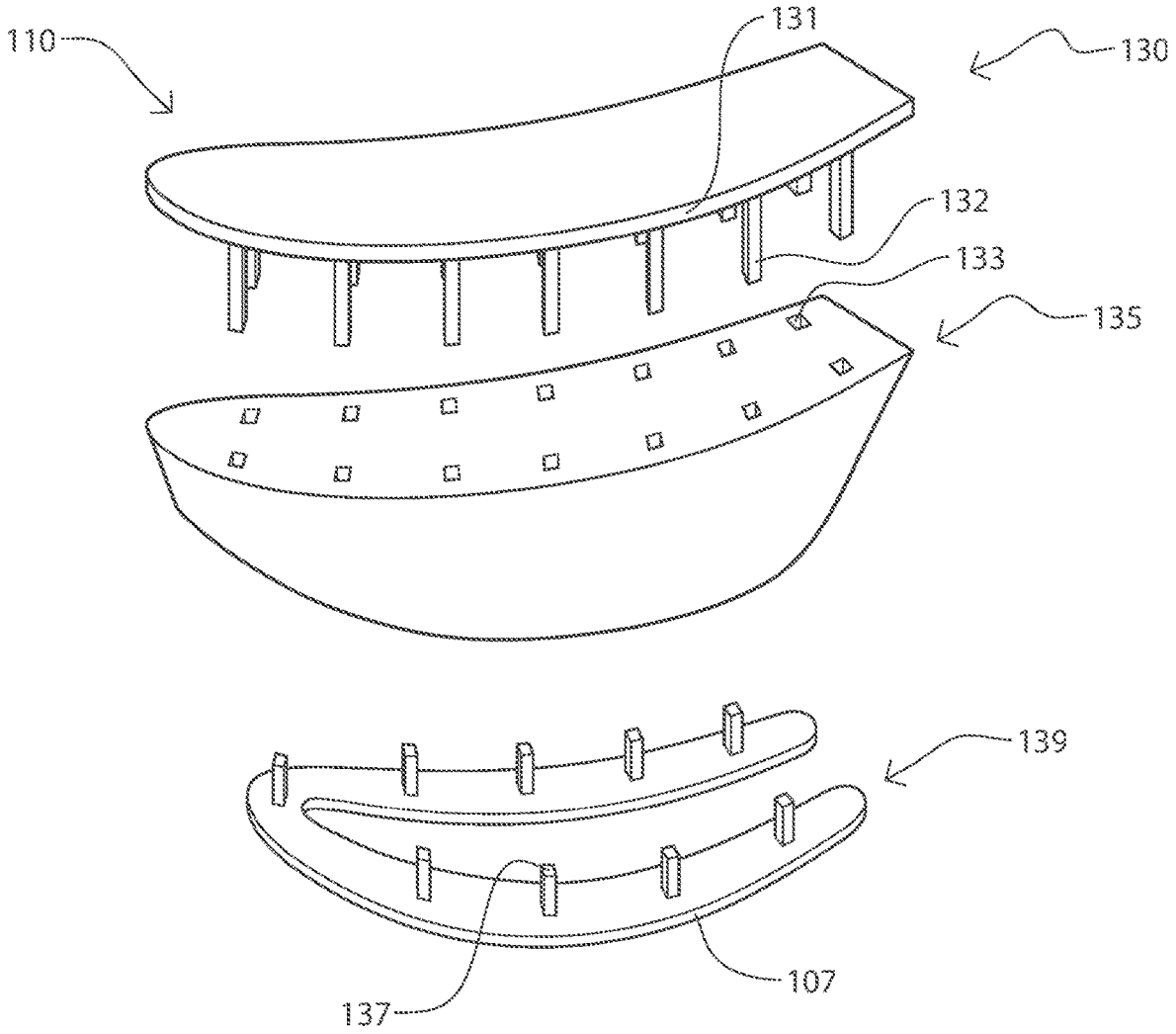
FIG. 32 is an expanded side perspective view of a construction unit including a shoe-unit interface, a mid-base, and a foundational base.
Figure 33:
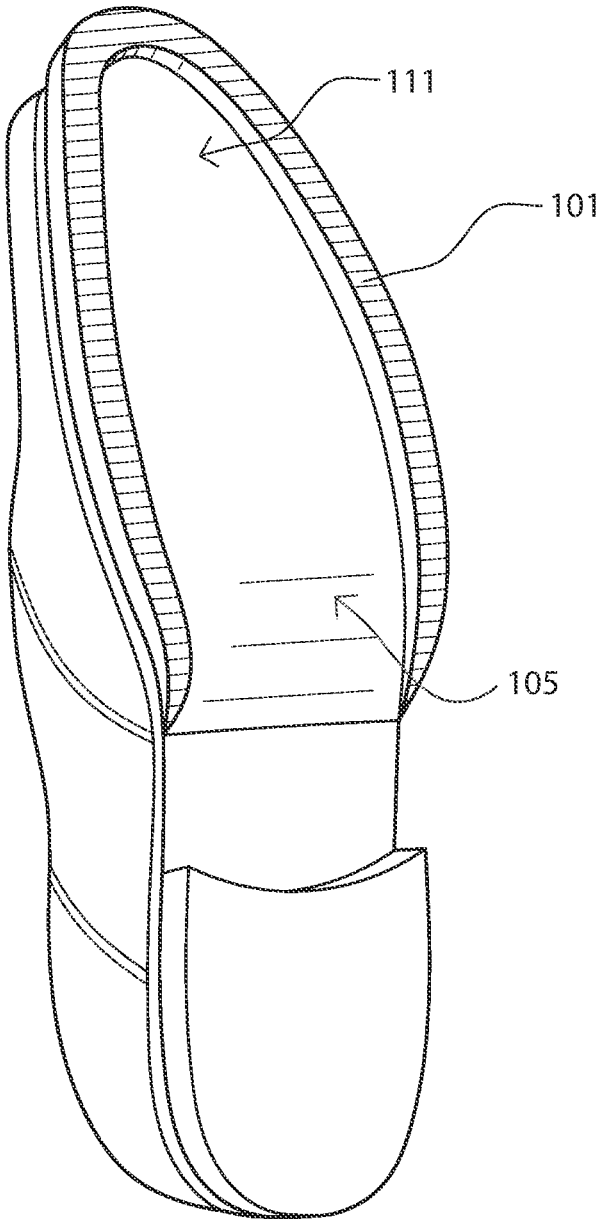
FIG. 33 is a perspective bottom view of a man's shoe incorporating the construction unit of the present invention.
Figure 34:
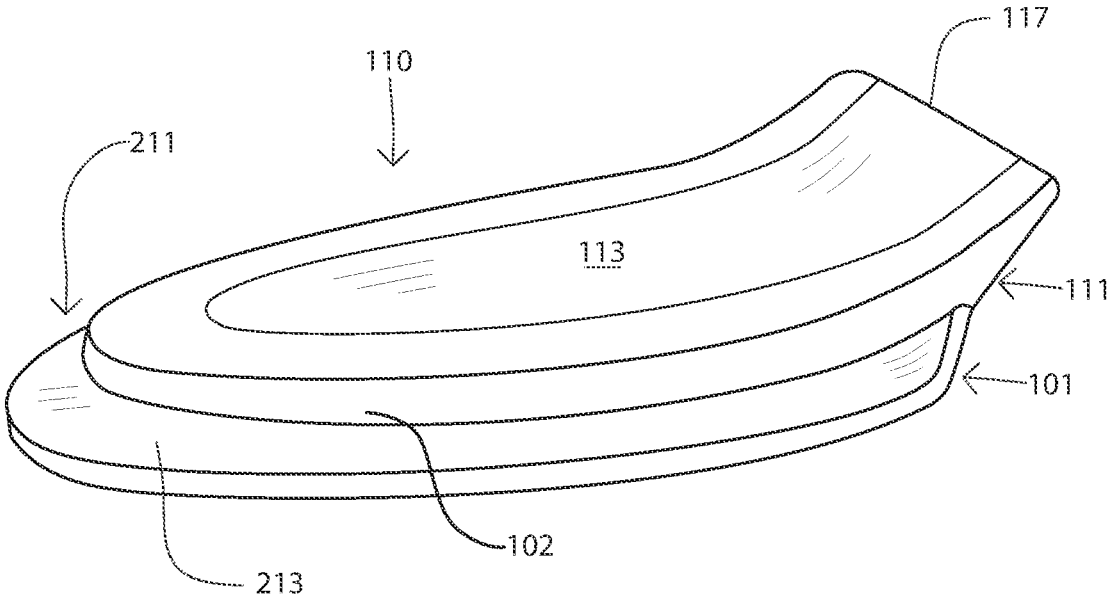
FIG. 34 is a perspective top view of a construction unit of the present invention having an inset weight-bearing wall, a bottom boundary flange, and a channel defined by the inset wall and flange.

FIG. 32 illustrates a seventh embodiment. In this embodiment, the construction unit 110 is not formed unitarily, but comprises multiple portions. In one aspect the multi-portion construction unit 110 comprises a mid-base 135, an upper shoe-unit interface 130, and a lower foundational base 139. In another aspect the construction unit 110 comprises a mid-base 135 and an upper shoe-unit interface 130 without the lower foundational base 139. The unit-to-shoe interface 130 is a thin structure that includes an interface foundation 131 and one or more downwardly protruding projections 132 that extend downwardly from the interface foundation 131. The interface foundation 131 has a bottom surface that conforms substantially to the top of the mid-base 135 and has a top surface that conforms substantially to the portion of the shoe to which it will be attached. The lower foundational base 139 is a thin structure having a top surface that conforms substantially to the mid-base's bottom surface, having upwardly protruding projections 137, and having a bottom surface for walking that is generally smooth and flat.

The mid-base 135 includes the upraised area 105 of the construction unit 110 of the first embodiment and additionally includes upper receiving holes 133 and lower receiving holes (not shown). The upper receiving holes 133 are sized and configured to receive the downwardly protruding projections 132, which are to be fixedly attached within the upper receiving holes 133. The lower receiving holes are sized and configured to receive the upwardly protruding projections 137, which are to be fixedly attached within the lower receiving holes. The upper receiving holes 133 may be offset from the downward receiving holes, particularly if the offsetting improves structural robustness.

The construction unit 110 of the seventh embodiment of FIG. 32 is utilized similarly to the construction unit 110 of the other embodiments, but it may provide advantages in weight reduction and/or in providing versatility in the use of different materials for different portions of the construction unit. The three elements of the construction unit 110 may be formed from the same or different materials. In one aspect, the construction unit 110 is formed of a plastic resin or composite material, while the shoe-unit interface 130 and the foundational base 139 may be formed of a metal or metal alloy (for example, nickel alloy or titanium). This provides a plastic and metal unit 110 of lighter weight than a construction unit 110 that is formed unitarily of metal or metal alloy.

The eighth embodiment of FIGS. 34-39 discloses a construction unit 110 that at least has a weight-bearing wall 101 that is inset from the periphery of the shoe and may optionally, as illustrated, also have a unit body inset from the shoe periphery.

In FIGS. 34-39 the unit body in and the upper portion of the wall are inset a small distance from the periphery of the shoe upper, in contrast with the fully inset wall 101 of FIG. 31 in which the entire wall was inset and the unit body was not inset.

FIGS. 34-39 also disclose a bottom boundary flange 213. In this aspect, the lower portion of the wall 101 extends outwardly beyond the inset unit body 111 and the inset upper portion of the wall to form the bottom boundary flange 213. Preferably, the vertical height of the flange 213 is less than the vertical height of the upper portion of the wall 101. The bottom boundary flange 213 extends outwardly beyond the outer surface of the top portion of the inset wall 101, may extends outwardly beyond the inset unit body in and the inset upper portion of the wall, may extend outwardly to the periphery of the shoe, or may extend beyond the shoe periphery. The outward facing surface 102 of the top portion of the inset wall 101 (and in the aspect shown, the outward facing surface of the unit body 111) along with the top surface of the flange 213 together define two sides (bottom and side) of an open décor-receiving channel 211. Décor-receiving channel 211 accommodates the decorative element 150.

Figure 35:
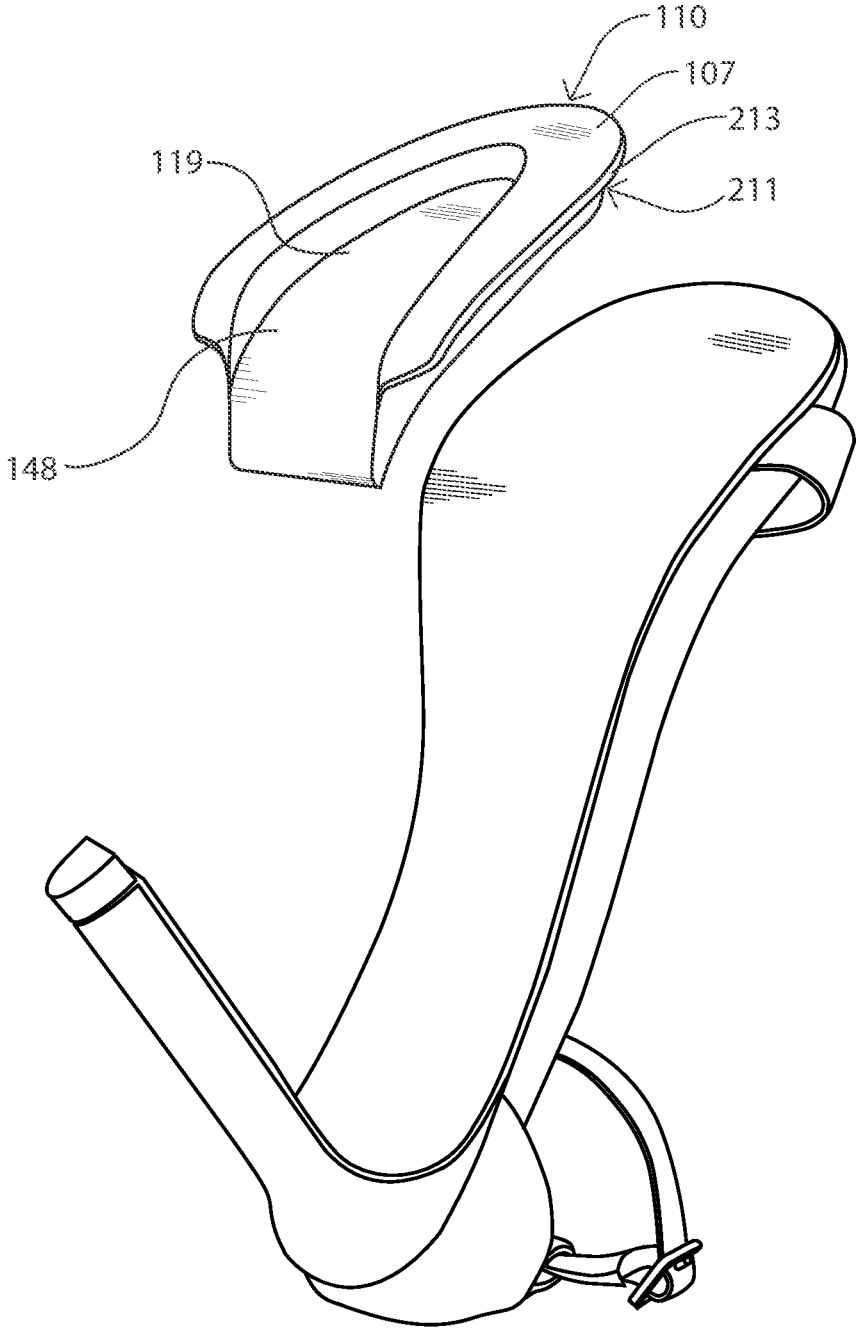
FIG. 35 is an expanded perspective bottom view of a shoe and inventive construction unit having an inset weight-bearing wall, a bottom boundary flange, and a channel defined by the inset wall and flange.
Figure 36:
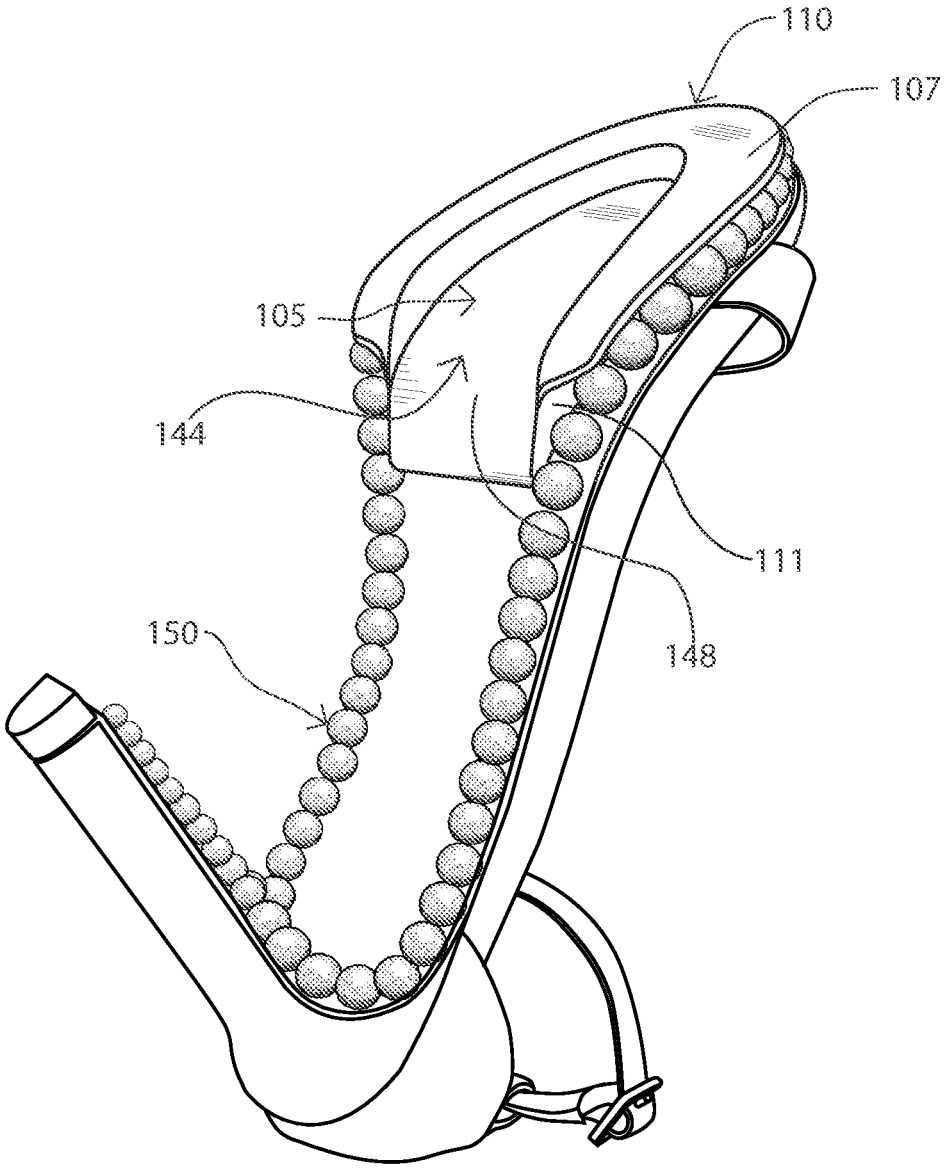
FIG. 36 is a perspective bottom view of a shoe, inventive construction unit, and decorative element, wherein the construction unit has an inset weight-bearing wall, a bottom boundary flange, and a channel defined by the inset wall and flange that has received a portion of the decorative element.
Figure 37:
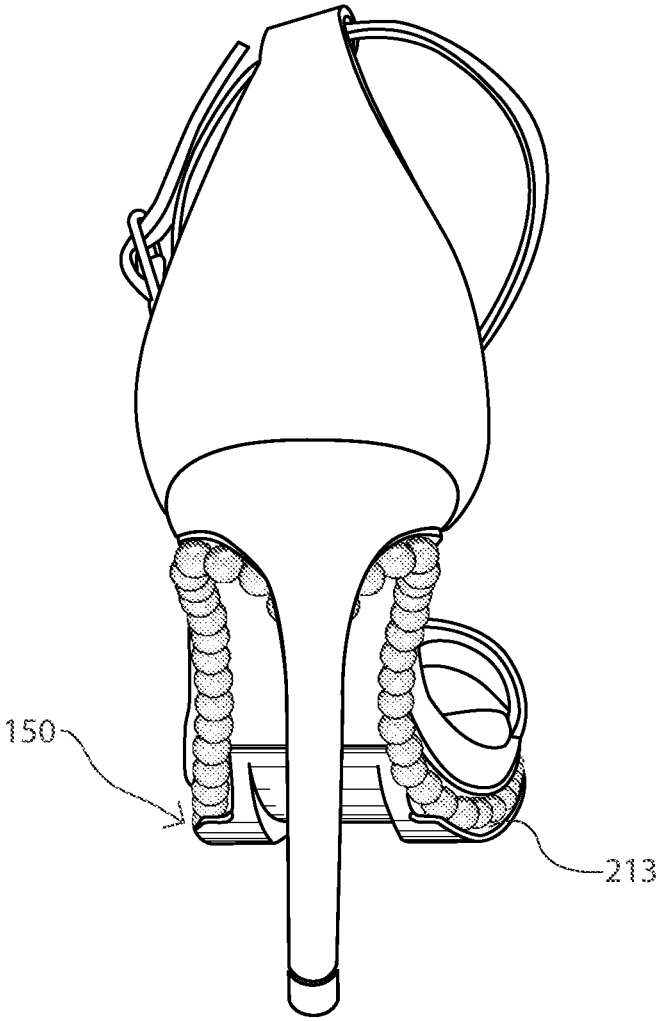
FIG. 37 is a back view of a shoe, inventive construction unit, and decorative element, wherein the construction unit has an inset weight-bearing wall, a bottom boundary flange, and a channel defined by the inset wall and flange that has received a portion of the decorative element.
Figure 38:
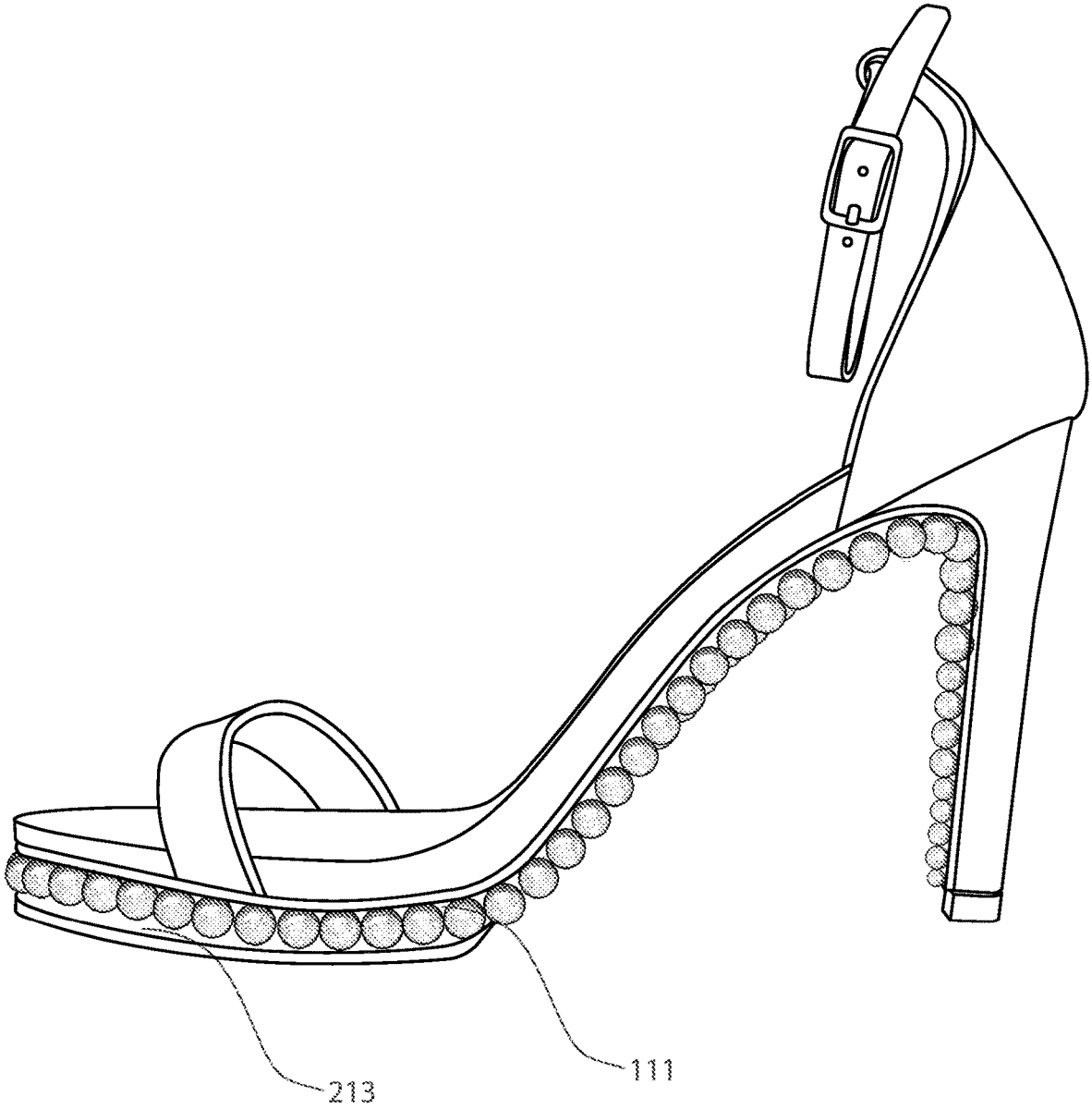
FIG. 38 is a side view of a shoe, inventive construction unit, and decorative element, wherein the construction unit has an inset weight-bearing wall, a bottom boundary flange, and a channel defined by the inset wall and flange to receive a portion of the decorative element.
Figure 39:
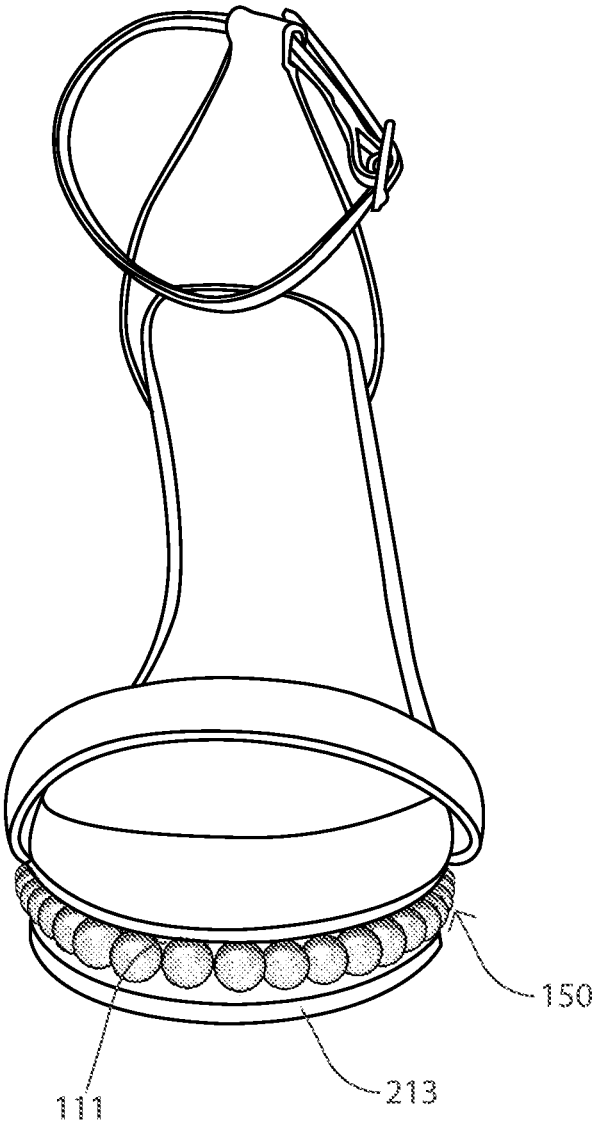
FIG. 39 is a front view of a shoe, inventive construction unit, and decorative element, wherein the construction unit has an inset weight-bearing wall, a bottom boundary flange, and a channel defined by the inset wall and flange that has received a portion of the decorative element.

FIG. 35 shows the construction unit 110 of this eighth embodiment in position for attaching to the bottom of the shoe. When the construction unit 110 of the eighth embodiment is incorporated into the shoe, the shoe forms a third side (the top side) of the décor-receiving channel 211. As can be seen in the bottom view of FIG. 36, the back view of FIG. 37, the side view of FIG. 38, and the front view of FIG. 39, a decorative element 150 (shown as a row of pearls or spheres) can be disposed within the disclosed décor-receiving channel 211 to achieve a unique, distinctive look. The row of decorative elements 150 may continue across the arch and down the heel, as illustrated, or may stop at the end of the toe or at other locations, as dictated by design considerations.

In the aspect in which the unit body in is not inset, but only the top portion of the inset wall 101 is inset, the outward facing surface 102 of the top portion of the inset wall 101 and the top surface of the flange 213 together define two sides (bottom and side) of the open décor-receiving channel 211. In this aspect, when the construction unit 110 is incorporated into the shoe, the bottom of the unit body 111 forms the top third side (top) of the décor-receiving channel 211.

FIG. 40 discloses a ninth embodiment in which the upraised area 105 within the construction unit is bowl-shaped. In this embodiment, the inner surface of wall 101 is not vertical, but is instead curved inwardly to form a gradually deepening upraised area 105. The inner surface of wall 101 curves from wall-boundary inner junction 120 to the body inner roof surface 119 to define the bowl-shape. This figure illustrates that the body inner roof surface 119 may be curved, the surface of wall 101 may be curved, the wall-boundary inner junction 120 may be curved or may form a greater than ninety-degree angle, and the roof-wall interface 205 (the location at which the body inner roof surface 119 meets the surface of the inner wall 104) may be curved.

The construction unit 110 of the embodiments may be formed of natural or manmade materials, such as plastic resins, metals, natural or synthetic wood, or a combination of materials. It may be formed unitarily, or it may be formed in parts that are permanently and non-removably joined together.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A shoe (50) comprising:

a shoe toe section (60);

a shoe arch section (55) disposed rearwardly of said shoe toe section (60);

a shoe heel section (53) disposed rearwardly of said shoe arch section (55);

a construction unit (110) comprising:

a unit body (111) comprising a body top surface (113) disposed generally at a first level and a body inner roof surface (119) disposed generally at a second level that is below said first level;

a weight-bearing wall (101) that extends downwardly from at least a portion of said unit body (111) and that does not extend downwardly from a center back area (148) of said unit body (111); said weight-bearing-wall (101) comprises a wall interior surface (104), a wall exterior surface (102), a wall bottom boundary (107), a wall right peripheral back margin (109), and a wall left peripheral back margin (109); wherein a right portion of said weight-bearing-wall (101) terminates rearwardly at said wall right peripheral back margin (109); wherein a left portion of said weight-bearing wall (101) terminates at said wall left peripheral back margin (109); wherein said weight-bearing-wall (101) terminates downwardly in said wall bottom boundary (107) that is disposed at a third level, which is disposed below said second level; and wherein said wall right peripheral back margin (109) and said wall left peripheral back margin (109) define a gap therebetween;

an upraised area (105) defined at least partially by said wall interior surface (104) and said body inner roof surface (119); wherein a rearward gap open space (144) is defined below a center area (148) and between said wall right peripheral back margin (109) and said wall left peripheral back margin (109) to allow viewing of said upraised area (150); and a decorative component (150) disposed on said body inner roof surface (119); and wherein the height of said weight-bearing-wall (101) is greater than the height of said decorative component (150) to cause said decorative component (150) to be elevated above said third level.

2. The shoe (50), as recited in claim 1, wherein said weight-bearing-wall (101) extends downwardly from at least a portion of a periphery of said unit body (111).

3. The shoe (50), as recited in claim 1, wherein said weight-bearing-wall (101) extends downwardly from a location inset from a periphery of said unit body (111).

4. The shoe (50), as recited in claim 1, wherein:

said weight-bearing-wall (101) comprises a bottom boundary flange (213) that is disposed at the bottom of said weight-bearing-wall (101) and that extends outwardly beyond an upper portion of said weight-bearing-wall (101); and said weight-bearing-wall (101) comprises a décor-receiving channel (211) with a channel bottom defined by a top surface of said bottom boundary flange (213) and with a channel side defined by a portion of said wall exterior surface (102).

5. The shoe (50), as recited in claim 4, said shoe (50) further comprising a channel decorative component (150) disposed within said décor-receiving channel (211).

6. The shoe (50), as recited in claim 1, wherein said wall interior surface (104) is curved to cause said upraised area (105) to be bowl-shaped.

7. The shoe (50), as recited in claim 1, wherein said unit body (111) further comprises an arch extension (191) and a heel extension (209).

8. A shoe (50), comprising:

a shoe toe section (60);

a shoe arch section (55) disposed rearwardly of said shoe toe section (60);

a shoe heel section (53) disposed rearwardly of said shoe arch section (55); and a construction unit (110) comprising:

a unit body (111) comprising a body top surface (113) disposed generally at a first level and a body inner roof surface (119) disposed generally at a second level that is below said first level;

a weight-bearing-wall (101) that extends downwardly from at least a portion of said unit body (111) and that does not extend downwardly from a center back area (148) of said unit body (111); said weight-bearing-wall (101) comprises a wall interior surface (104), a wall exterior surface (102), a wall bottom boundary (107), a wall right peripheral back margin (109), and a wall left peripheral back margin (109); wherein a right portion of said weight-bearing-wall (101) terminates rearwardly at said wall right peripheral back margin (109); wherein a left portion of said weight-bearing wall (101) terminates at said wall left peripheral back margin (109); wherein said weight-bearing-wall (101) terminates downwardly in said wall bottom boundary (107) that is disposed at a third level, which is disposed below said second level; and wherein said wall right peripheral back margin (109) and said wall left peripheral back margin (109) define a gap therebetween; wherein said weight-bearing wall (101) extends downwardly from a location inset from a periphery of said unit body (111); and an upraised area (105) defined at least partially by said wall interior surface (104) and said body inner roof surface (119); wherein a rearward gap open space (144) is defined below a center area (148) and between said wall right peripheral back margin (109) and said wall left peripheral back margin (109) to allow viewing of said upraised area (150);

wherein:

said weight-bearing-wall (101) comprises a bottom boundary flange (213) disposed at a bottom of said weight-bearing-wall (101) and extending outwardly beyond an upper portion of said weight-bearing-wall (101);

said weight-bearing-wall (101) comprises a décor-receiving channel (211) with a channel bottom defined by a top surface of said bottom boundary flange (213) and with a channel side defined by a portion of said wall exterior surface (102);

said shoe (50) further comprises an elevated decorative component (150) disposed on said body inner roof surface (119);

said shoe (50) further comprises a channel decorative component (150) disposed within said décor-receiving channel (211); and said weight-bearing-wall (101) has a height greater than a height of said elevated decorative component (150) to cause said elevated decorative component (150) to be elevated above a walking surface.

9. A shoe construction unit (110) comprising:

a unit body (111) configured for attaching to a shoe toe (60); said unit body (111) comprising an inward unit body portion (111A) and an outward unit body portion (111B);

wherein said outward unit body portion (111B) comprises body slits (251) defined by slit borders (252) and comprises a between-slit area (253) disposed between said body slits (251);

wherein said inward unit body portion (111A) comprises a weight-bearing-wall (101);

wherein said weight-bearing-wall (101) comprises right and left back wall margins (109);

wherein said weight-bearing-wall (101) extends downwardly from a portion of said inward unit body portion (111A) to terminate in a wall bottom boundary (107);

wherein said weight-bearing-wall (101) does not extend downwardly from a center area (148) between said right and left back wall margins (109);

wherein a rearward gap open space (144) is defined below said center area (148) and between said right and left back wall margins (109); and wherein, when said inward unit body portion (111A) is attached to said shoe toe (60) and said outward unit body portion (111B) is attached over said inward unit body portion (111A), said weight-bearing-wall (101) extends through said body slits (251).

10. The shoe construction unit (110), as recited in claim 9, wherein, when said inward unit body portion (111A) is attached to said shoe toe (60) and said outward unit body portion (111B) is attached over said inward unit body portion (111A), said between-slit area (253) receives a decorative component (150).

11. The shoe construction unit (110), as recited in claim 9, wherein said weight-bearing wall (101) extends downwardly from a location inset from a periphery of said inward unit body portion (111A).

12. The shoe construction unit (110), as recited in claim 9, wherein:

said inward unit body portion (111A) comprises a body top portion surface (113) disposed at a first level;

when said inward unit body portion (111A) is attached to said shoe toe (60), said inward unit body portion (111A) extends from a front portion of said shoe toe (60) to at least a back portion of said shoe toe (60);

when said inward unit body portion (111A) is attached to said shoe toe (60), said center between-slit area (253) is disposed at a second level below said first level; and when said inward unit body portion (111A) is attached to said shoe toe (60), said wall bottom boundary (107) lies substantially in a third level disposed below said second level.

13. The shoe construction unit (110), as recited in claim 9, further comprising a finishing outsole (259) configured with outsole slits (258); wherein, when said inward unit body portion (111A) is attached to said shoe toe (60) and said outward unit body portion (111B) is attached over said inward unit body portion (111A), said finishing outsole (259) is attached over said outward unit body portion (111B) with said weight-bearing-wall (101) extending through said body slits (251) and through said outsole slits (258).

* * * * *